US008564632B2

(12) United States Patent
Matsutani

(10) Patent No.: US 8,564,632 B2
(45) Date of Patent: Oct. 22, 2013

(54) THERMAL PRINTER

(75) Inventor: Megumi Matsutani, Okazaki (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 433 days.

(21) Appl. No.: 13/029,679

(22) Filed: Feb. 17, 2011

(65) Prior Publication Data

US 2011/0242255 A1 Oct. 6, 2011

(30) Foreign Application Priority Data

Mar. 31, 2010 (JP) ..... 2010-084498
Mar. 31, 2010 (JP) ..... 2010-084499

(51) Int. Cl.
*B41J 2/36* (2006.01)

(52) U.S. Cl.
USPC ..... 347/188; 347/190; 347/195

(58) Field of Classification Search
USPC ..... 347/188, 190, 195, 196, 211; 400/120.15, 120.09, 120.1
See application file for complete search history.

(56) References Cited

U.S. PATENT DOCUMENTS

| | | | |
|---|---|---|---|
| 4,127,883 | A | 11/1978 | Mestdagh |
| 4,567,488 | A | 1/1986 | Moriguchi et al. |
| 4,880,325 | A | 11/1989 | Ueda et al. |
| 4,892,425 | A | 1/1990 | Shimizu et al. |
| 4,915,516 | A | 4/1990 | Shimizu et al. |
| 4,927,278 | A | 5/1990 | Kuzuya et al. |
| 4,983,058 | A | 1/1991 | Nagae |
| 5,188,469 | A | 2/1993 | Nagao et al. |
| 5,203,951 | A | 4/1993 | Hattori et al. |
| 5,223,939 | A | 6/1993 | Imaizumi et al. |
| RE34,521 | E | 1/1994 | Shimizu et al. |
| 5,277,503 | A | 1/1994 | Nagao |
| 5,348,406 | A | 9/1994 | Yoshiaki et al. |
| 5,350,243 | A | 9/1994 | Ichinomiya et al. |
| 5,374,132 | A | 12/1994 | Kimura |
| 5,411,339 | A | 5/1995 | Bahrabadi et al. |
| 5,419,648 | A | 5/1995 | Nagao et al. |
| 5,429,443 | A | 7/1995 | Kobayashi et al. |

(Continued)

FOREIGN PATENT DOCUMENTS

| | | | |
|---|---|---|---|
| EP | 0329369 | A2 | 8/1989 |
| EP | 0511602 | A1 | 11/1992 |

(Continued)

OTHER PUBLICATIONS

Japanese Office Action of JP 2010-084500 dated Jul. 13, 2012.

(Continued)

*Primary Examiner* — Huan Tran
(74) *Attorney, Agent, or Firm* — McCarter & English, LLP

(57) ABSTRACT

A thermal printer includes a thermal head and a control unit that controls energization of each of a plurality of heater elements based on printing data including a plurality of line data arrays corresponding to the plurality of heater elements respectively, for selectively heating up the plurality of heater elements, and performs printing according to an order at the printing data while taking a line data array as a basic unit, on each printing cycle including a heating period and a non-heating period. The control unit delays a start of a heating period in a printing cycle with respect to a start of the printing cycle for a predetermined time period when a predetermined condition with respect to the line data array is satisfied.

9 Claims, 12 Drawing Sheets

(56) References Cited

U.S. PATENT DOCUMENTS

| | | | | |
|---|---|---|---|---|
| 5,466,076 | A | 11/1995 | Kobayashi et al. | |
| 5,494,362 | A | 2/1996 | Kobayashi et al. | |
| 5,538,352 | A | 7/1996 | Sugiura | |
| 5,540,510 | A | 7/1996 | Sims et al. | |
| 5,564,843 | A | 10/1996 | Kawaguchi | |
| 5,593,237 | A | 1/1997 | Nozaki et al. | |
| 5,620,268 | A | 4/1997 | Yamaguchi et al. | |
| 5,653,542 | A | 8/1997 | Sugimoto et al. | |
| 5,659,441 | A | 8/1997 | Eckberg et al. | |
| 5,727,888 | A | 3/1998 | Sugimoto et al. | |
| 5,730,536 | A | 3/1998 | Yamaguchi | |
| 5,771,803 | A | 6/1998 | Takami | |
| 5,813,773 | A | 9/1998 | Kawai | |
| 5,825,724 | A | 10/1998 | Matsumoto et al. | |
| 5,964,539 | A | 10/1999 | Yamaguchi et al. | |
| 6,042,280 | A | 3/2000 | Yamaguchi et al. | |
| 6,048,118 | A | 4/2000 | Martinez et al. | |
| 6,059,469 | A | 5/2000 | Hirumi | |
| 6,116,796 | A | 9/2000 | Yamaguchi et al. | |
| 6,132,120 | A | 10/2000 | Yamaguchi et al. | |
| 6,168,328 | B1 | 1/2001 | Ueda et al. | |
| 6,190,069 | B1 | 2/2001 | Yamaguchi et al. | |
| 6,196,740 | B1 | 3/2001 | Yamaguchi et al. | |
| 6,317,156 | B1 | 11/2001 | Nagasaki et al. | |
| 6,334,724 | B2 | 1/2002 | Yamaguchi et al. | |
| 6,406,202 | B1 | 6/2002 | Unno et al. | |
| 6,435,744 | B1 | 8/2002 | Dunn et al. | |
| 6,476,838 | B1 | 11/2002 | Italiano | |
| 6,485,206 | B1 | 11/2002 | Takahashi | |
| 6,520,696 | B2 | 2/2003 | Huss et al. | |
| 6,709,179 | B2 | 3/2004 | Yamaguchi et al. | |
| 6,801,233 | B2 * | 10/2004 | Bhatt et al. | 347/175 |
| 7,121,751 | B2 | 10/2006 | Harada et al. | |
| 7,128,483 | B2 | 10/2006 | Harada et al. | |
| D534,203 | S | 12/2006 | Harada et al. | |
| 7,166,558 | B2 * | 1/2007 | Bhatt et al. | 503/204 |
| D542,334 | S | 5/2007 | Harada et al. | |
| 7,304,658 | B2 * | 12/2007 | Naito et al. | 347/195 |
| 7,388,686 | B2 * | 6/2008 | Saquib et al. | 358/1.8 |
| 7,791,626 | B2 * | 9/2010 | Busch et al. | 347/211 |
| 7,830,455 | B2 * | 11/2010 | Hsieh et al. | 348/678 |
| 7,965,308 | B2 | 6/2011 | Jauert et al. | |
| 8,045,288 | B2 | 10/2011 | Ota et al. | |
| 8,098,269 | B2 * | 1/2012 | Busch et al. | 347/211 |
| 8,109,684 | B2 | 2/2012 | Yamaguchi | |
| 8,162,553 | B2 | 4/2012 | Vandermeulen | |
| 8,164,609 | B2 | 4/2012 | Liu et al. | |
| 2002/0006303 | A1 | 1/2002 | Yamaguchi et al. | |
| 2002/0012558 | A1 | 1/2002 | Huss et al. | |
| 2002/0047063 | A1 | 4/2002 | Kaneda et al. | |
| 2004/0233269 | A1 | 11/2004 | Tsubota | |
| 2005/0172981 | A1 | 8/2005 | Byun | |
| 2006/0204304 | A1 | 9/2006 | Hioki et al. | |
| 2006/0233582 | A1 | 10/2006 | Horiuchi | |
| 2006/0239743 | A1 | 10/2006 | Naito | |
| 2007/0009306 | A1 | 1/2007 | Harada et al. | |
| 2007/0035610 | A1 * | 2/2007 | Naito | 347/171 |
| 2007/0041772 | A1 | 2/2007 | Harada et al. | |
| 2007/0070168 | A1 | 3/2007 | Mindler et al. | |
| 2007/0237562 | A1 | 10/2007 | Kato et al. | |
| 2008/0050160 | A1 | 2/2008 | Yamaguchi et al. | |
| 2008/0080922 | A1 | 4/2008 | Vandermeulen | |
| 2008/0181708 | A1 | 7/2008 | Yamaguchi et al. | |
| 2008/0226373 | A1 | 9/2008 | Yamaguchi et al. | |
| 2008/0310904 | A1 | 12/2008 | Yamaguchi et al. | |
| 2009/0016795 | A1 | 1/2009 | Caveney et al. | |
| 2009/0202283 | A1 | 8/2009 | Kumazaki et al. | |
| 2011/0058884 | A1 | 3/2011 | Kato et al. | |

FOREIGN PATENT DOCUMENTS

| | | | |
|---|---|---|---|
| EP | 0629509 | | 12/1994 |
| EP | 0644506 | | 3/1995 |
| EP | 0684143 | | 11/1995 |
| EP | 0734878 | | 10/1996 |
| EP | 1199179 | | 4/2002 |
| EP | 1284196 | A2 | 2/2003 |
| EP | 1516739 | | 3/2005 |
| EP | 1700705 | | 9/2006 |
| EP | 1707395 | | 10/2006 |
| EP | 2236304 | | 10/2010 |
| JP | 58-139415 | | 9/1983 |
| JP | 6-328800 | | 11/1984 |
| JP | 60-99692 | | 6/1985 |
| JP | 63-166557 | A | 7/1988 |
| JP | 63-203348 | A | 8/1988 |
| JP | 63-254085 | A | 10/1988 |
| JP | 3-093584 | A | 4/1991 |
| JP | 3-120680 | | 5/1991 |
| JP | 3063155 | | 9/1991 |
| JP | 5-16342 | | 3/1993 |
| JP | 3-118672 | | 9/1993 |
| JP | 5-78565 | | 10/1993 |
| JP | 5-80765 | U | 11/1993 |
| JP | 5-294051 | | 11/1993 |
| JP | 6-12053 | | 2/1994 |
| JP | 6-21953 | U | 3/1994 |
| JP | 6-124406 | | 5/1994 |
| JP | 6-152907 | A | 5/1994 |
| JP | 6-53560 | U | 7/1994 |
| JP | 6-183117 | | 7/1994 |
| JP | 6-191081 | A | 7/1994 |
| JP | 6-210889 | A | 8/1994 |
| JP | H06-74348 | | 10/1994 |
| JP | 7-1805 | | 1/1995 |
| JP | 7-9743 | | 1/1995 |
| JP | 7-25123 | | 1/1995 |
| JP | 7-47737 | | 2/1995 |
| JP | 7-314866 | | 2/1995 |
| JP | 7-61009 | | 3/1995 |
| JP | 7-69497 | | 3/1995 |
| JP | 7020725 | | 3/1995 |
| JP | 7-89196 | | 4/1995 |
| JP | 7-101133 | | 4/1995 |
| JP | 7-108702 | A | 4/1995 |
| JP | H07-089115 | | 4/1995 |
| JP | 7-137327 | | 5/1995 |
| JP | 7-40456 | | 7/1995 |
| JP | 7-237314 | A | 9/1995 |
| JP | 7-251539 | | 10/1995 |
| JP | 7-276695 | | 10/1995 |
| JP | 7-276695 | A | 10/1995 |
| JP | 7-290803 | | 11/1995 |
| JP | 7-314864 | | 12/1995 |
| JP | H07-314865 | | 12/1995 |
| JP | 8-25768 | | 1/1996 |
| JP | 8-39909 | | 2/1996 |
| JP | 8-58211 | A | 3/1996 |
| JP | 8-118738 | | 5/1996 |
| JP | 8-252964 | A | 10/1996 |
| JP | 8-267839 | A | 10/1996 |
| JP | 8-290618 | | 11/1996 |
| JP | 2596263 | | 4/1997 |
| JP | 9-134557 | | 5/1997 |
| JP | 9-141986 | A | 6/1997 |
| JP | 9-188049 | | 7/1997 |
| JP | 9-188050 | | 7/1997 |
| JP | 10-056604 | A | 2/1998 |
| JP | 10-181063 | A | 7/1998 |
| JP | 11-78188 | | 3/1999 |
| JP | 11-105351 | | 4/1999 |
| JP | 11-129563 | | 5/1999 |
| JP | 11-263055 | | 9/1999 |
| JP | 3543659 | | 9/1999 |
| JP | 2000-25251 | | 1/2000 |
| JP | 2998617 | | 1/2000 |
| JP | 2000-43336 | | 2/2000 |
| JP | 2000-85224 | | 3/2000 |
| JP | 2000-103129 | | 4/2000 |
| JP | 2000-103131 | | 4/2000 |
| JP | 2000-135843 | | 5/2000 |
| JP | 2000-198258 | | 7/2000 |
| JP | 2001-11594 | | 1/2001 |

(56) References Cited

FOREIGN PATENT DOCUMENTS

| | | | |
|---|---|---|---|
| JP | 2001-48389 | | 2/2001 |
| JP | 4-37575 | | 5/2001 |
| JP | 2001-121797 | A | 5/2001 |
| JP | 2001-310540 | | 11/2001 |
| JP | 2001-319447 | | 11/2001 |
| JP | 2002-42441 | | 2/2002 |
| JP | 3266739 | B2 | 3/2002 |
| JP | 2002-104568 | | 4/2002 |
| JP | 2002-179300 | | 6/2002 |
| JP | 2002-308481 | | 10/2002 |
| JP | 2002192769 | | 10/2002 |
| JP | 2002-367333 | | 12/2002 |
| JP | 3357128 | | 12/2002 |
| JP | 2003-048337 | A | 2/2003 |
| JP | 2003-251902 | | 9/2003 |
| JP | 2003-285522 | | 10/2003 |
| JP | 4-133756 | | 5/2004 |
| JP | 2004-291591 | | 10/2004 |
| JP | 2004-323241 | | 11/2004 |
| JP | 2005-088597 | A | 4/2005 |
| JP | 2005-231203 | | 9/2005 |
| JP | 2005-280008 | | 10/2005 |
| JP | 2005297348 | | 10/2005 |
| JP | 4061507 | | 11/2005 |
| JP | 2006096030 | | 4/2006 |
| JP | 2006-142835 | | 6/2006 |
| JP | 2006-182034 | | 7/2006 |
| JP | 2006-240310 | A | 9/2006 |
| JP | 2006-248059 | | 9/2006 |
| JP | 2006-272895 | | 10/2006 |
| JP | 2006-272977 | | 10/2006 |
| JP | 2006-289991 | | 10/2006 |
| JP | 2007-196654 | A | 8/2007 |
| JP | 2007-296863 | | 11/2007 |
| JP | 4003068 | | 11/2007 |
| JP | 5-63067 | | 4/2008 |
| JP | 2008-80668 | | 4/2008 |
| JP | 2008-509823 | A | 4/2008 |
| JP | 2008083432 | | 4/2008 |
| JP | 2008-229855 | A | 10/2008 |
| JP | 2009-28976 | | 2/2009 |
| JP | 2009-509812 | A | 3/2009 |
| JP | 2009-184832 | A | 8/2009 |
| JP | 5-155067 | | 3/2010 |
| JP | 2011-110843 | A | 6/2011 |
| JP | 2011-110845 | A | 6/2011 |
| JP | 2011-110848 | A | 6/2011 |
| JP | 5-54225 | | 10/2012 |
| WO | 2000/032401 | | 1/2000 |
| WO | 03/080350 | | 10/2003 |
| WO | 2006/024913 | | 3/2006 |
| WO | 2006/090842 | | 8/2006 |
| WO | 2009/107534 | A1 | 9/2009 |

OTHER PUBLICATIONS

Japanese Office Action of JP 2010-084501 dated Jul. 3, 2012.
Japanese Office Action of JP 2010-084502 dated Jul. 3, 2012.
Notification of reasons for rejection issued in the related Japanese Application No. 2009-088241, Nov. 15, 2011, JPO, Japan.
International Preliminary Report on Patentability of PCT/JP2009/071812 dated Aug. 14, 2012.
Japanese Office Action of JP 2009-086172 dated Sep. 11, 2012.
Japanese Office Action of JP 2009-088449 dated Sep. 11, 2012.
Japanese Office Action of JP 2010-084500 dated Jul. 3, 2012.
European Communication of EP 10711477.9 dated Sep. 6, 2012.
NZ Examination Report of NZ 596044 dated Sep. 28, 2012.
International Preliminary Report on Patentability in PCT/JP2009/071568 on Nov. 15, 2011.
International Preliminary Report on Patentability in PCT/JP2010/055324 on Nov. 15, 2011.
International Preliminary Report on Patentability in PCT/JP2010/055326 on Nov. 15, 2011.
International Preliminary Report on Patentability in PCT/JP2010/050253 on Nov. 15, 2011.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
Japanese Office Action in JP 2009-086239 on May 8, 2012.
Japanese Office Action in JP 2009-086222 on Jun. 12, 2012.
International Preliminary Report on Patentability in PCT/JP2010/055310 on Apr. 1, 2012.
Japanese Office Action of JP 2009-270056 dated Nov. 13, 2012.
Japanese Office Action of JP 2009-297502 dated Nov. 13, 2012.

* cited by examiner

THERMAL PRINTER

CROSS REFERENCE TO RELATED APPLICATIONS

The present application claims priority from Japanese Patent Applications No. JP 2010-084498 which was filed on Mar. 31, 2010 and No. 2010-084499 which was filed on Mar. 31, 2010, the disclosure of which is incorporated herein by reference in its entirety.

TECHNICAL FIELD

The disclosure relates to a thermal printer that includes a thermal head on which a plurality of heater elements are arranged, and that performs printing by selectively controlling energization of each of the plurality of heater elements.

BACKGROUND

There have conventionally been proposed various thermal printers which are provided with a thermal head on which a plurality of heater elements are arranged, and configured to perform printing by selectively controlling energization of each heater element. In the thermal printers, it is selectively controlled whether to energize or de-energize each of the plurality of heater elements according to printing data, so as to heat up the plurality of heater element. Such thermal printers generate heat at heater elements so as to heat heat-sensitive paper and form colors thereon, or to transfer a thermal fusion ink, for performing printing according to the printing data.

As described above, a thermal printer performs printing by generating heat at heater elements; then, the thermal head and the heater elements gradually store heat as the printing proceeds. The printing cycle at the thermal printer consists of heating period for heating up the heater elements and non-heating period for dissipating heat in the heater elements, but if heat is stored above dissipating ability of the thermal head in the thermal head or the heater elements, it may adversely affect the sensitivity of the heat-sensitive paper or the melting of the ink, resulting in highly dark printing. Also, this sometimes causes collapse, trailing or uneven density in printed materials, deteriorating the printing quality.

There has been known a thermal printer configured to address the above problem. The thermal printer prevents the occurrence of uneven density in the printed materials by controlling the energy of an energization pulse to apply to the thermal head, on the basis of the temperature in the vicinity of the thermal head.

In the field of the above thermal printers, there has been desired high-speed printing to reduce the print time. In addition, even if the print cycle becomes short for coping with the high-speed printing, sufficient energy should be secured for printing. In a case where the energy amount of energization pulse is controlled as in the thermal printer, voltage-resistant components or components with improved capacitance have to be used in the thermal head, etc. and this drives up the cost.

If the printing cycle is shortened, the proportion of a heating period in the printing cycle increases. Thereby, a non-heating period is shortened in the printing cycle at the time of high-speed printing. As a result, the time period for dissipating the heat from the thermal head and heater elements is also shortened, and the thermal head becomes apt to store heat, causing collapse, trailing or uneven density in printed materials, and resulting in considerably degrading the printing quality.

SUMMARY

The disclosure relates to a thermal printer configured to perform print by energizing a thermal head, and has an object to provide a thermal printer capable of realizing a high printing-quality and of coping with high-speed printing.

To achieve the purpose of the disclosure, there is provided a thermal printer including a thermal head including a plurality of heater elements aligned in a main scanning direction, and a control unit that controls energization of each of the plurality of heater elements based on printing data including a plurality of line data arrays corresponding to the plurality of heater elements respectively, for selectively heating up the plurality of heater elements, and performs printing according to an order at the printing data while taking a line data array as a basic unit, on each printing cycle including a heating period for heating up by energizing the plurality of heater elements and a non-heating period for dissipating heat by de-energizing the plurality of heater elements, wherein the control unit delays a start of a heating period in a printing cycle with respect to a start of the printing cycle for a predetermined time period when a predetermined condition with respect to the line data array is satisfied.

DETAILED DESCRIPTION

A detailed description of an exemplary embodiment of a tape printing apparatus 1 embodying a thermal printer directed to the disclosure will now be given referring to the accompanying drawings, the tape printing apparatus 1 carrying out printing on a tape fed from a tape cassette.

First, the schematic structure of the tape printing apparatus 1 directed to a first embodiment will be described by referring to drawings. The tape printing apparatus 1 directed to the first embodiment carries out printing on a tape fed from a tape cassette 5 (refer to FIG. 2) housed inside a cabinet of the printing apparatus 1, using a thermal head 41.

Figure 1:
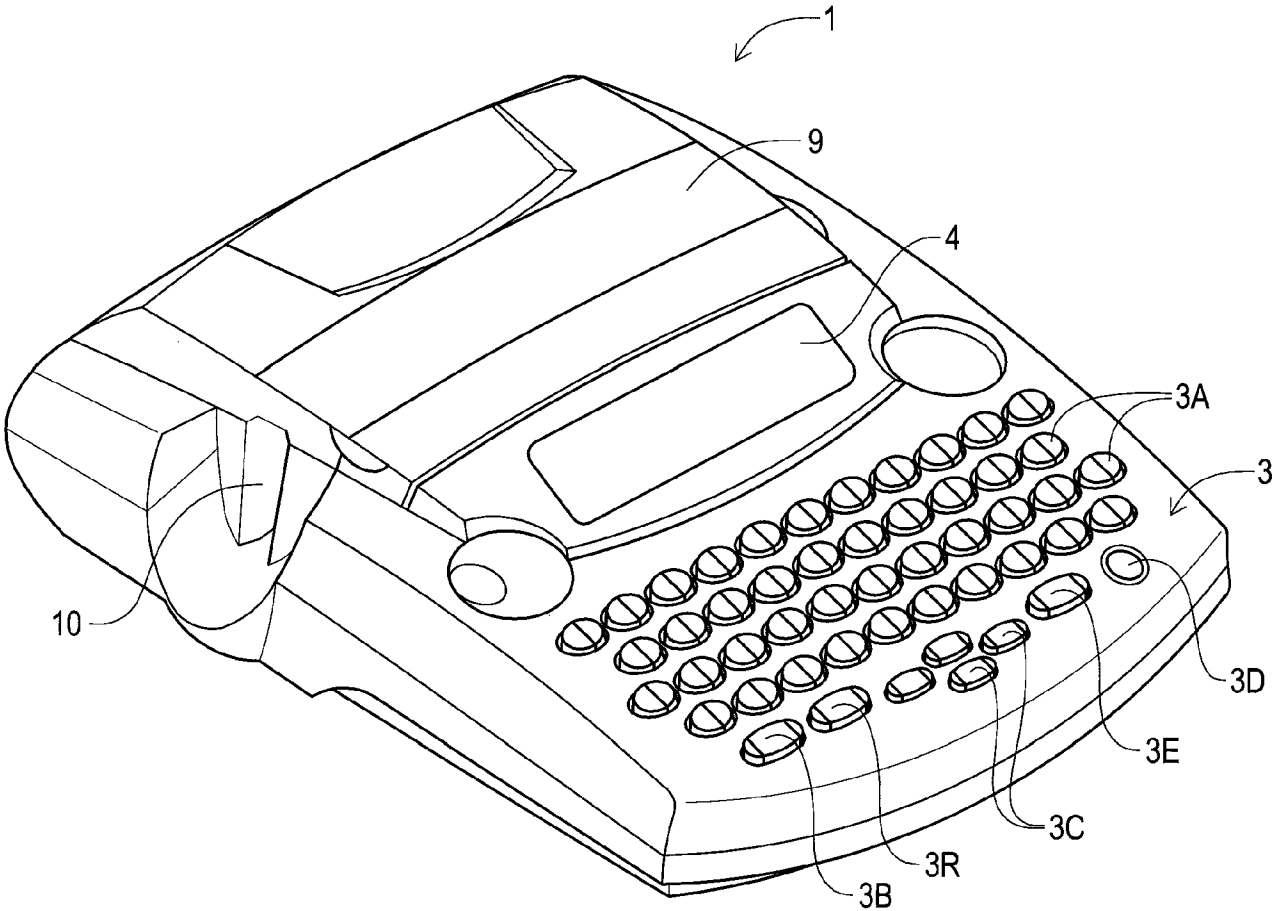
FIG. 1 is a perspective view of a tape printing apparatus directed to one aspect of the present disclosure.

As shown in FIG. 1, the tape printing apparatus 1 includes a keyboard 3 and a liquid crystal display 4 on the top of the cabinet. Further, a housing cover 9 is provided on the upper surface of the cabinet in an openable and closable manner. When the housing cover 9 is closed, the housing cover 9 covers a cassette holding portion 8 which is formed inside the cabinet. The cassette holding portion 8 holds the tape cassette 5 that is rectangular in shape when seen from above. Beneath the keyboard 3, a control board (not shown) is arranged.

A tape ejecting portion 10 for ejecting a printed tape is formed at the left side of the cassette holding portion 8. Further, a connection interface (not shown) is arranged at the right side of the tape printing apparatus 1. The connection interface is used for connecting the tape printing apparatus 1 to an external apparatus (e.g., a personal computer, etc.) in a manner of either wireline connection or wireless connection. Accordingly, the tape printing apparatus 1 is capable of printing out printing data transmitted from an external apparatus.

The keyboard 3 includes plural operation keys such as character input keys 3A, a print key 3B, cursor keys 3C, a power key 3D, a setting key 3E, a return key 3R, etc. The character input keys 3A are operated for inputting characters that create texts consisting of document data. The print key 3B is operated for giving a command to print out printing data consisting of created texts, etc. The cursor keys 3C are operated for moving a cursor being indicated in the liquid crystal display 4 up, down, left or right. The power key 3D is operated for turning on or off the power of the main body of the tape printing apparatus 1. The setting key 3E is operated for setting various conditions (setting of printing density and the like). The return key 3R is operated for executing a line feeding instruction or various processing and for determining a choice from candidates.

The liquid crystal display 4 is a display device for indicating characters such as letters, etc. in plural lines. The liquid crystal display 4 can display a content of printing data (see FIG. 4) created by the keyboard 3, various setting screens, and the like.

Figure 2:
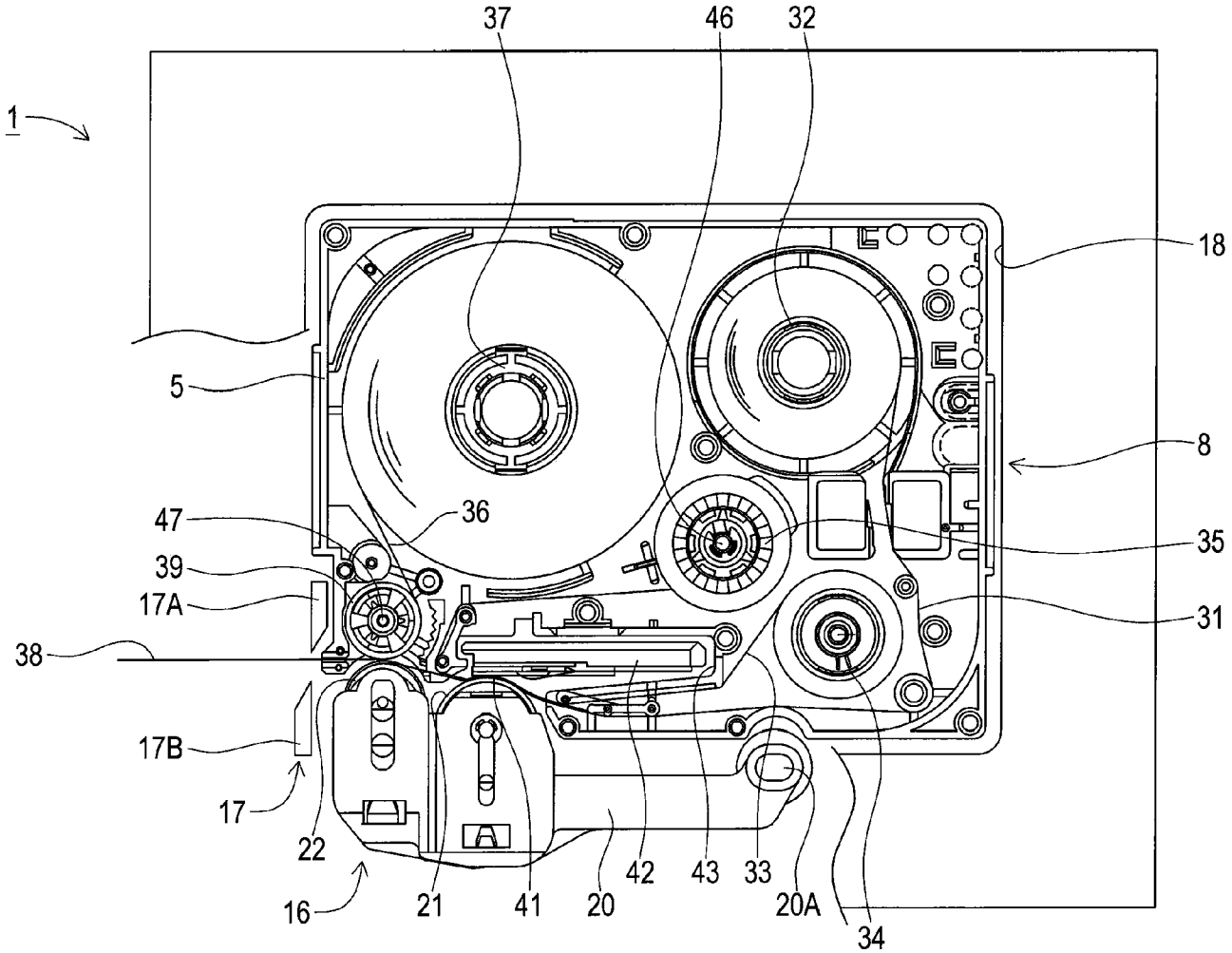
FIG. 2 is a diagram illustrating a vicinity of a cassette holding portion for the tape printing apparatus.
Figure 3:
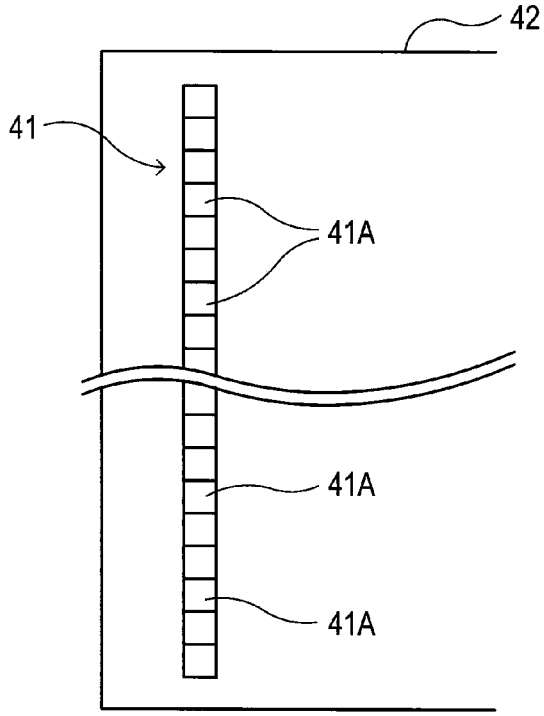
FIG. 3 is a diagram of a thermal head for the tape printing apparatus.

As shown in FIG. 2, the tape printing apparatus 1 is configured such that the tape cassette 5 can be loaded in the cassette holding portion 8 arranged inside thereof. Further, inside the tape printing apparatus 1, a tape driving-and-printing mechanism 16 and a tape cutting mechanism are arranged. The tape printing apparatus 1 is capable of carrying out printing onto a tape fed from the tape cassette 5 by the tape driving-and-printing mechanism 16 in accordance with desired printing data.

The tape cutting mechanism includes a cutter 17 made up of a fixed blade 17A and a rotary blade 17B. Accordingly, the tape printing apparatus 1 is capable of cutting off a printed part of a tape with the cutter 17 constituting the tape cutting mechanism. As above discussed, the printed part of the tape thus cut off is ejected from the tape ejecting portion 10.

Inside the tape printing apparatus 1, a cassette holding frame 18 is arranged. As shown in FIG. 2, the tape cassette 5 is loaded into the cassette holding frame 18 in a removable and replaceable manner.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 is wound around the tape spool 32. The surface tape 31 is a transparent tape made of such as PET (polyethylene terephthalate) film or the like. An ink ribbon 33 is wound around the ribbon feeding spool 34. On the ink ribbon 33, there is applied ink that melts or sublimes when heated. A part of the ink ribbon 33 that has been used for printing is taken up in the used-ribbon-take-up spool 35. A double tape 36 is wound around the base-material-sheet feeding spool 37. The double tape 36 is formed by bonding a release tape to one side of a double-sided adhesive tape wherein the double-sided adhesive tape includes adhesive agent layers at both sides thereof, with the same width as the surface tape 31. The double tape 36 is wound around the base-material-sheet feeding spool 37 so that the release tape is put outside. The bonding roller 39 is used for bonding the double tape 36 and the surface tape 31 together.

As shown in FIG. 2, in the cassette holding frame 18, an arm 20 is arranged around a shaft 20A in a pivotal manner. A platen roller 21 and a conveying roller 22 are rotatably supported at the front edge of the arm 20. Both the platen roller 21 and the conveying roller 22 employ a flexible member made of rubber or the like for their surfaces.

When the arm 20 fully swings clockwise, the platen roller 21 presses the surface tape 31 and the ink ribbon 33 against the thermal head 41 to be described later in detail. At the same time, the conveying roller 22 presses the surface tape 31 and the double tape 36 against the bonding roller 39.

A plate 42 is arranged upright inside the cassette holding frame 18. The plate 42 includes the thermal head 41 at its side surface facing the platen roller 21. The thermal head 41 consists of a plurality of (e.g. 128 or 256) heater elements 41A aligned in the width direction of the surface tape 31 and the double tape 36. Accordingly, the main scanning direction of the thermal head 41 is the same as the width direction of the surface tape 31 and the like.

When the tape cassette 5 is placed in a predetermined position, the plate 42 is fitted in a concave portion 43 of the tape cassette 5.

Further, a ribbon-take-up roller 46 and a bonding-roller driving roller 47 are arranged upright inside the cassette holding frame 18 (refer to FIG. 2). When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

In the cassette holding frame 18, there is arranged a tape conveying motor (not shown). Driving force of the tape conveying motor is transmitted to the platen roller 21, the conveying roller 22, the ribbon-take-up roller 46 and the bonding-roller driving roller 47, etc. via series of gears arranged along the cassette holding frame 18. Accordingly, when rotation of an output shaft of the tape conveying motor is started with supply of power to the tape conveying motor, rotation of the used-ribbon-take-up spool 35, the bonding roller 39, the platen roller 21 and the conveying roller 22 is started in conjunction with the operation of the tape conveying motor. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 go through a path between the platen roller 21 and the thermal head 41 in a superimposed state. Accordingly, in the tape printing apparatus 1, the surface tape 31 and the ink ribbon 33 are conveyed while being pressed by the platen roller 21 and the thermal head 41. The significant number of the heater elements 41A aligned on the thermal head 41 are selectively and intermittently energized by a control unit 60 (refer to FIG.

5) in accordance with printing data (refer to FIG. 4) and an energization control process program (FIG. 6), etc. to be described later.

Figure 4:
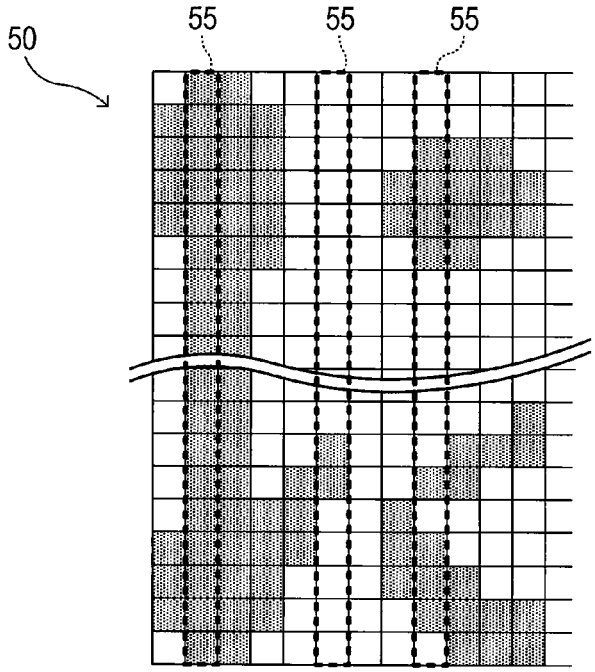
FIG. 4 is a diagram illustrating an example of print data.

Printing data 50 is input through an operation on the keyboard 3 or external apparatuses via the connection interface. As illustrated in FIG. 4, the printing data 50 is made up of a group of dots each of which corresponding to a heater element 41A and also made up of a plurality of printing line data arrays 55. Each printing line data array 55 is formed by dots of the same number of the heater elements 41A aligned on the thermal head 41, and defines whether to energize or de-energize each heater element 41A in a single printing cycle T. The printing data 50 includes a plurality of printing line data arrays 55 for printing lines arranged in a predetermined order in a sub scanning direction (i.e., the tape conveying direction). That is, the tape printing apparatus 1 executes print on a tape based on the printing data 50 by processing each of the printing line data arrays 55 according to the predetermined order in a unit of the printing cycle T.

Each heater element 41A gets heated by power supply and melts or sublimes ink applied on the ink ribbon 33. Therefore, ink in the ink layer on the ink ribbon 33 is transferred onto the surface tape 31 in a certain unit of dots. Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the bonding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 to reach the tape cutting mechanism including the cutter 17. The tape cutting mechanism contains the cutter 17 and the tape cutting motor 72 (refer to FIG. 5). The cutter 17 includes a fixed blade 17A and a rotary blade 17B. More specifically, the cutter 17 is a scissors-like cutter that cuts off an object to be cut off by rotating the rotary blade 17B against the fixed blade 17A. The rotary blade 17B is arranged so as to be able to rotate back and forth with reference to a shaft thereof with the aid of the tape cutting motor 72. Accordingly, the laminated tape 38 is cut off with the fixed blade 17A and the rotary blade 17B along operation of the tape cutting motor 72.

The laminated tape 38 thus cut off is ejected outside of the tape printing apparatus 1 via the tape ejecting portion 10. By peeling off the release paper from the double tape 36 and exposing the adhesive agent layer, the laminated tape 38 can be used as an adhesive label that can be adhered to an arbitrary place.

Figure 5:
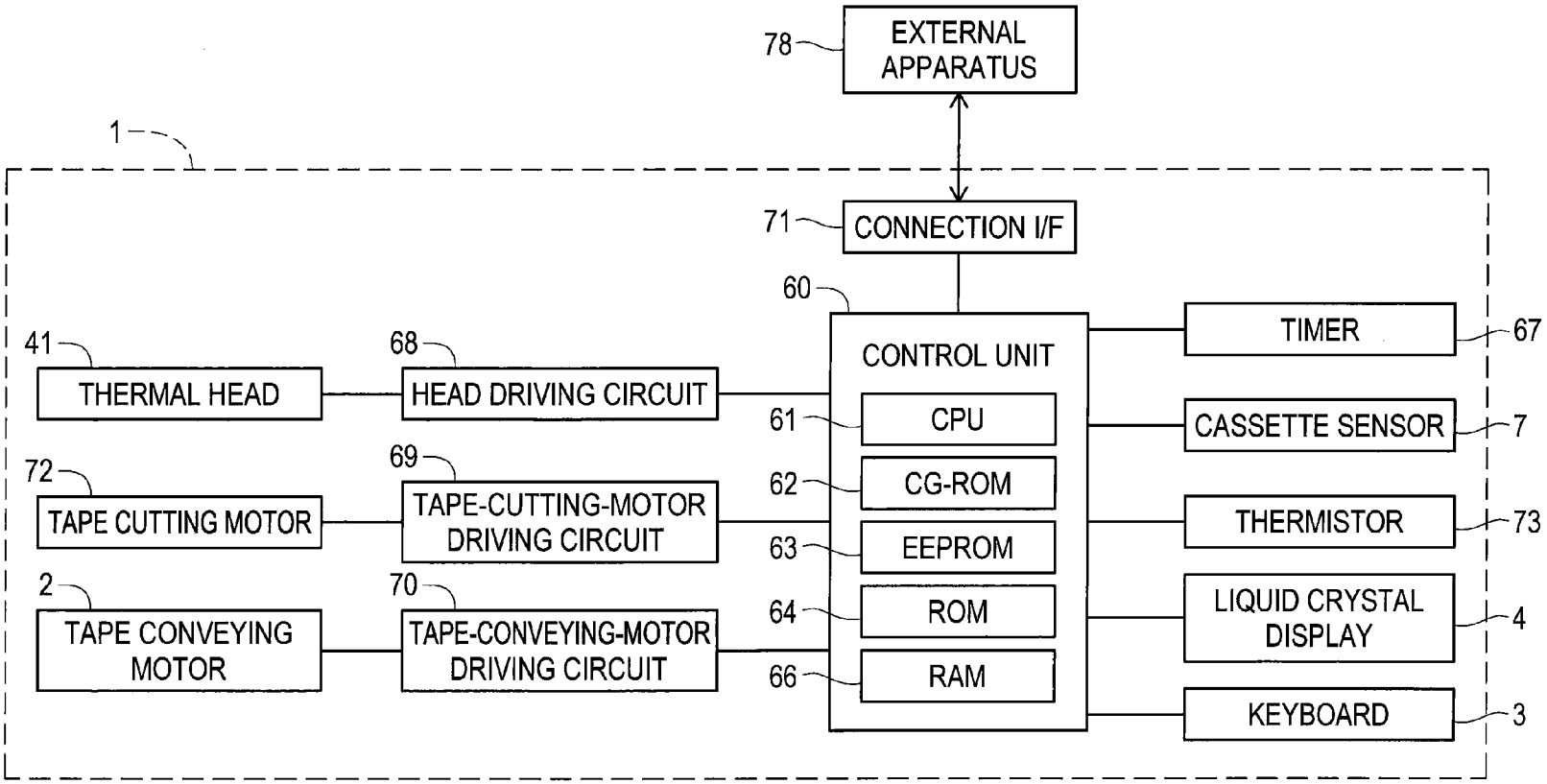
FIG. 5 is a block diagram illustrating control system of the tape printing apparatus.

Next, there will be described a control configuration of the tape printing apparatus 1 by referring to FIG. 5. Inside the tape printing apparatus 1, there is arranged a control board (not shown) on which a control unit 60, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to a timer 67, the head driving circuit 68, the tape-cutting-motor driving circuit 69 and the tape-conveying-motor driving circuit 70. The control unit 60 is also connected to a liquid crystal display 4, a cassette sensor 7, a thermistor 73, a keyboard 3 and a connection interface 71.

The CPU 61 is a central processing unit that plays a primary role for various kinds of system control of the tape printing apparatus 1. Accordingly, the CPU 61 controls various peripheral devices in accordance with input signals from the keyboard 3 etc. as well as various control programs including an energization control process program to be described later.

The CG-ROM 62 is a character generator memory wherein image data of to-be-printed letters and signs are associated with code data and stored in dot patterns. The EEPROM 63 is a non-volatile memory that allows data write for storing therein and deletion of stored data therefrom. The EEPROM 63 stores data that indicates user setting etc. of the tape printing apparatus 1.

The ROM 64 stores various control programs and various data for the tape printing apparatus 1. Accordingly, the energization control process program, etc. to be described later are stored in the ROM 64. The RAM 66 is a storing device for temporarily storing a processing result of the CPU 61 etc. The RAM 66 also stores print data created with inputs by means of the keyboard 3, printing data taken therein from external apparatuses 78 via the connection interface 71. The timer 67 is a time-measuring device that measures passage of predetermined length of time for executing control of the tape printing apparatus 1. Further, the thermistor 73 is a sensor that detects temperature of the thermal head 41 and attached on the thermal head 41.

The head driving circuit 68 is a circuit that serves to supply a driving signal to the thermal head 41, based on a control signal from the CPU 61, the energization control process program to be described later, etc., for controlling operation manners of the thermal head 41. In this connection, the head driving circuit 68 controls to energize and de-energize each of the heater elements 41A based on a signal (strobe signal (STB signal) corresponding to a strobe number associated with each heater element 41A for comprehensively controlling heating manner of the thermal head 41.

The tape-cutting-motor driving circuit 69 is a circuit that serves to supply a driving signal to the tape cutting motor 72 in response to a control signal from the CPU 61 for controlling operation of the tape cutting motor 72. Further, the tape-conveying motor driving circuit 70 serves to supply a driving signal to a tape conveying motor 2 based on the control signal from the CPU 61 for controlling operation of the tape conveying motor 2.

Figure 6:
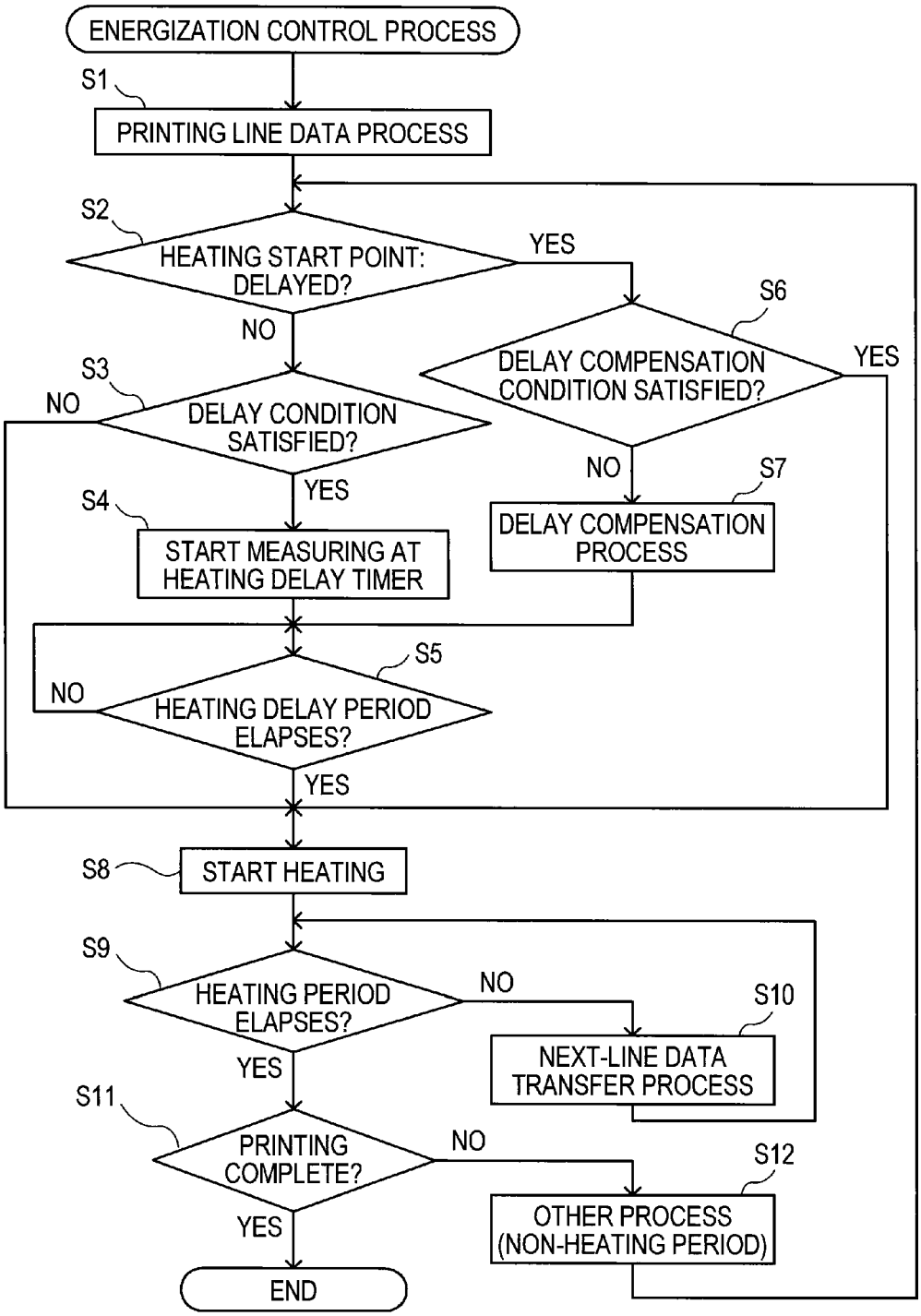
FIG. 6 is a flowchart of an energization control process program directed to a first embodiment.

Next, there will be described the energization control process program directed to a first embodiment by referring to FIG. 6. The energization control process program is a program the CPU 61 executes when printing the printing data 50, for performing energization control of each of the plurality of the heater elements 41A.

First, at S1, the CPU 61 executes a printing line data process. In the printing line data process (S1), the CPU 61 prefetches the printing data 50 (see FIG. 4), confirms (counts) dots that conforms to a heating condition, and creates each printing line data array 55. Then, the CPU 61 transfers the printing line data array 55 to the thermal head 41. Then the CPU 61 shifts the process to S2.

At S2, the CPU 61 determines whether a heating period H in the last printing period is in a delayed state where it is delayed from the start of the printing period T. If it is in a delayed state (YES at S2), the CPU 61 shifts the process to S6. If it is not in a delayed state (NO at S2), the CPU 61 shifts the process to S3.

Figure 7A:
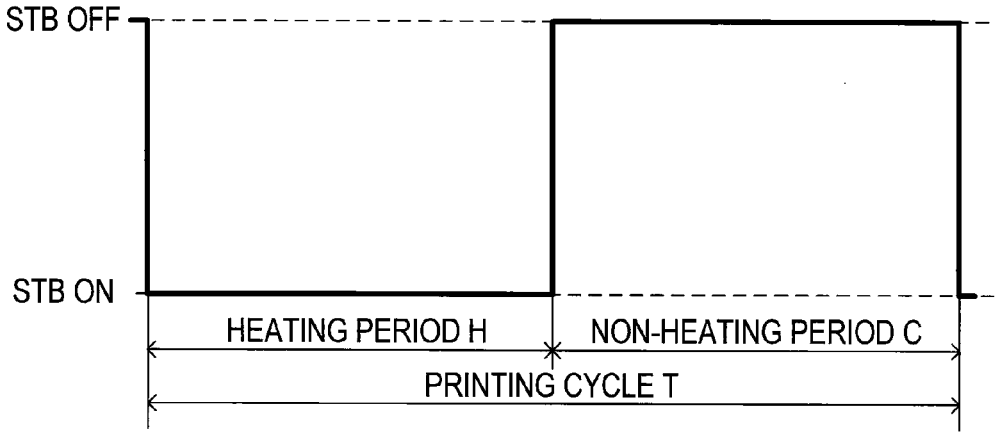
FIGS. 7A and 7B are diagrams illustrating configurations of a heating period and a non-heating period in a printing cycle directed to the first embodiment.
Figure 7B:
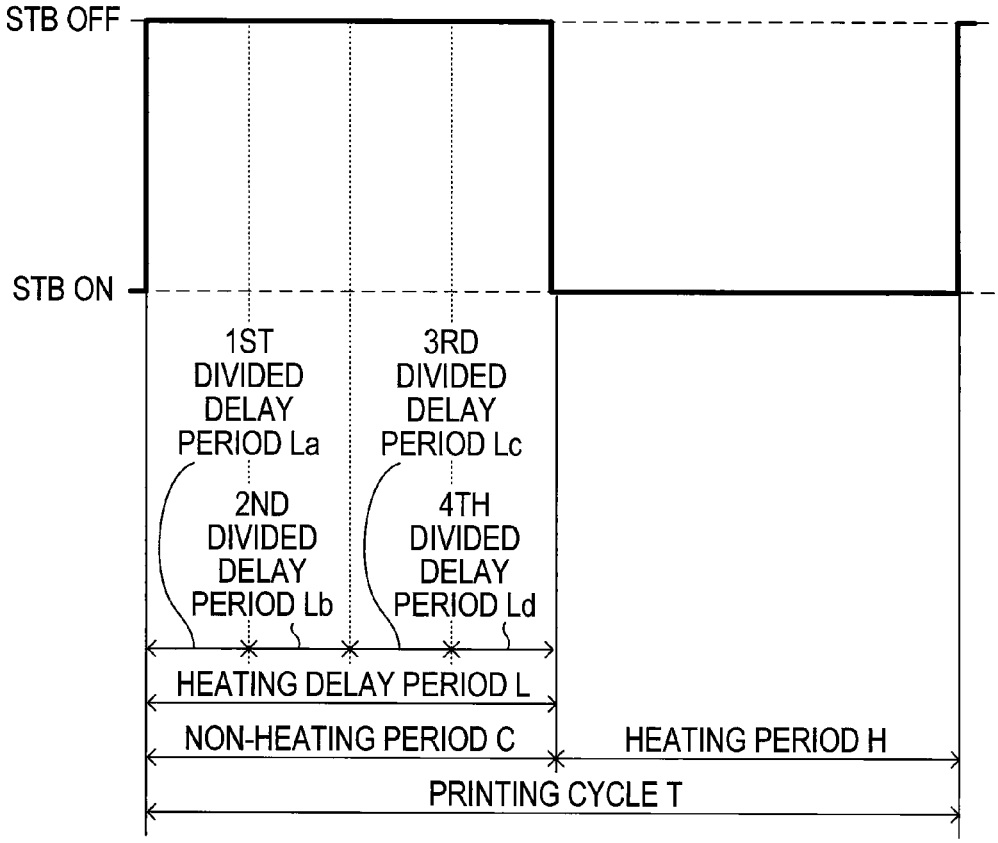
Figure 8A:
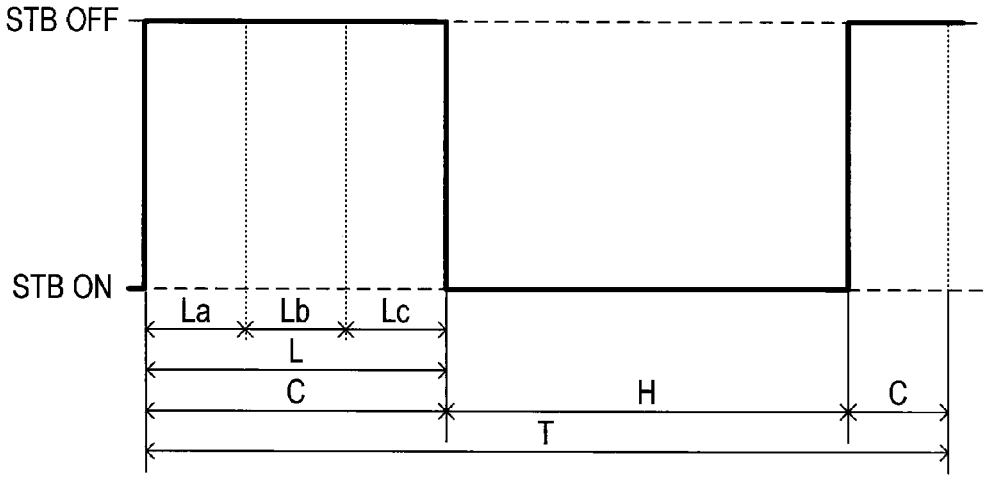
FIGS. 8A through 8C are diagrams illustrating configurations of a printing cycle based on a delay restoration process.
Figure 8B:
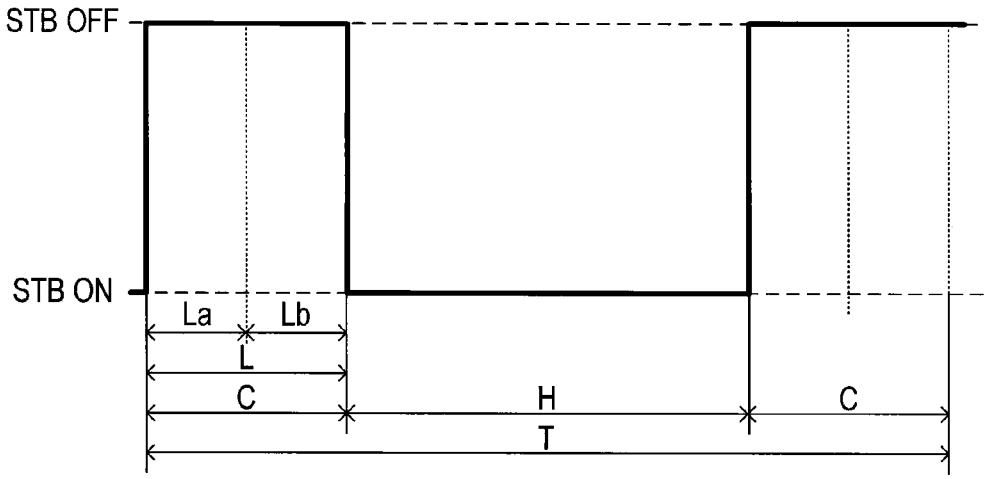
Figure 8C:
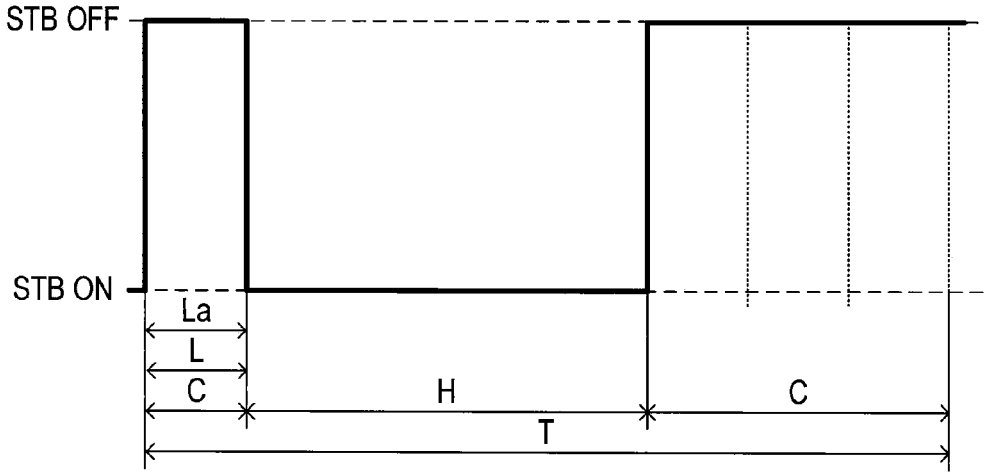

As has been described above, printing of one printing line data array 55 is performed in one printing cycle T, which is made up of a heating period H and a non-heating period C. As illustrated in FIG. 7A, basically, the heating period H is started at the same moment as the start of the printing period T, and after the elapse of the heating period H, the non-heating period C is provided in the printing period T, in the first embodiment. In case as illustrated in FIG. 7A, the CPU 61 determines that it is not in a delayed state. Then, the tape printing apparatus 1 directed to the first embodiment can set a delayed state where the start of the heating period H is delayed for a predetermined heating delay period L from the start of the printing cycle T if a delay condition which is previously set is satisfied (see FIG. 7B and FIGS. 8A through 8C). For instance, if a state is as illustrated in FIG. 7B or FIGS. 8A through 8C, it is determined that the heating period H is in a delayed state. Each of FIGS. 7 and 8 is a graph with a voltage level of the STB signal on the vertical axis, and a time scale on the horizontal axis.

Shifting to S3, the CPU 61 determines whether a delay condition is satisfied or not. The delay condition means a condition for delaying the start of the heating period from the start of the printing period T. In the first embodiment, the delay condition is satisfied when both requirements "a printing line data array 55 contains more than a predetermined number of dots (i.e., heater elements 41A) conforming to the heating condition and more than two such printing line data arrays 55 continue, including a printing line data array 55 which is the current printing target" and "there are less than a predetermined number of dots conforming to the heating condition in a printing line data array 55 of the next printing target" are met. If the delay condition is satisfied (YES at S3), the CPU 61 shifts the process to S4. If the delay condition is not satisfied (NO at S3), the CPU 61 shifts the process to S8.

At S4, the CPU 61 starts measuring the time at a heating delay timer, when the delay condition is satisfied. The heating delay timer is a timer for measuring a heating delay period L and performs the time measuring using a clock number in the CPU 61. In other words, the heating delay timer is a timer for measuring a start of heating period H based on the start of the printing cycle T when the heating delay period L is provided. If the above delay condition is satisfied as illustrated in FIG. 7B, the heating period H is set to start after being delayed for the heating delay period L from the start of the printing cycle T, and to end at the same time as the printing cycle T ends. When the measuring of the time is started at the heating delay timer, the CPU 61 shifts the process to S5.

At S5, the CPU 61 determines whether the heating delay period L has elapsed from the start of the printing cycle T, based on the measuring result of the heating delay timer. If the heating delay period L has elapsed (YES at S5), the CPU 61 shifts the process to S8. If the heating delay period L has not elapsed (NO at S5), the CPU 61 stands by until the heating delay period L elapses (that is, until the start of the heating period H).

At S6, to which the process is to shift when the last printing cycle T is in a delayed state (see FIG. 7B or FIGS. 8A through 8C), the CPU 61 determines whether a delay restoration condition is satisfied. The delay restoration condition is, as illustrated in FIG. 7B and FIGS. 8A through 8C, a condition for restoring the heating delay period L which is set before the heating period H at once, and returning to a normal state (see FIG. 7A). In the first embodiment, the delay restoration condition is defined as "there are no dots conforming to the heating condition in a printing line data array 55 of the next printing target." If the delay restoration condition is satisfied (YES at S6), the CPU 61 sets the heating delay period L to be "0" and makes the start of the heating period H synchronized with the start of the printing period T (see FIG. 7A), and shifts the process to S8. As a result, the CPU 61 can restore the heating delay period L at once, and can return to a normal state, if the delay restoration condition is satisfied. Even if the last printing cycle T is in a state as illustrated in FIGS. 8A through 8C, the CPU 61 restores the heating delay period L at once and returns to a normal state, if the delay restoration condition is satisfied. If the delay restoration condition is not satisfied (NO at S6), the CPU 61 shifts the process to S7.

At S7, the CPU 61 executes the delay restoration process. As illustrated in FIG. 7B, the heating delay period L may consist of a first divided delay period La, a second divided delay period Lb, a third divided delay period Lc and a fourth divided delay period Ld. The first divided delay period La through the fourth divided delay period Ld are each a time period obtained by dividing the heating delay period L (see FIG. 7B) immediately after satisfying the delay condition into four equal parts. In the delay restoration process (S7), the CPU 61 sets a heating delay period L for the current printing cycle T in a number smaller by one than the number of the divided delay periods making up the heating delay period L in the last printing cycle T.

For instance, if the heating delay period L in the last printing cycle T is made up of the first divided delay period La through the fourth divided delay period Ld (see FIG. 7B), the CPU 61 makes up the heating delay period L for the current printing cycle T with the first divided delay period La through the third divided delay period Lc (see FIG. 8A). In a similar manner, if the last printing cycle T is in a state as illustrated in FIG. 8A, a heating delay period L for the current printing cycle T is made up of the first divided delay period La and the second divided delay period Lb. If the last printing cycle T is in a state as illustrated in FIG. 8B, a heating delay period L for the current printing cycle T is made up of the first divided delay period La. Then, in the delay restoration process (S7), the CPU 61 sets a value corresponding to the number of the divided delay periods making up the current heating delay period L as a value for the heating delay timer. If the last printing cycle T is in a state as illustrated in FIG. 8C, the CPU 61 restores the heating delay period L directed to the current printing period T and sets the value of the heating delay timer to be "0". After terminating the delay restoration process (S7), the CPU 61 shifts the process to S8.

Upon shifting to S8, the CPU 61 outputs a control signal to the head driving circuit 68 based on a printing line data array 55 of the printing target, and starts to heat the heater elements 41. Thereby, power is supplied to the dots conforming to the heating condition in the printing line data array 55. Then the CPU 61 shifts the process to S9.

At S9, the CPU 61 determines whether the heating period H has elapsed. The heating period H is a predetermined time period, and the CPU 61 executes the determination by referring to the value of the timer 67, etc. If the heating period H has elapsed (YES at S9), the CPU 61 shifts the process to S11. If the heating period H has not yet elapsed (NO at S9), the CPU 61 shifts the process to S10.

Upon shifting to S10, the CPU 61 executes a next line data transfer process. In the next line data transfer process (S10), the CPU 61 transfers to the thermal head 41 a printing line data array 55 of the next printing target. Specifically, the CPU 61 transfers, to the thermal head 41, pulse data based on the printing line data array 55 of the next printing target. Then, the CPU 61 returns the process to S9. In FIG. 6, the shift to S10 is configured to be executed until the heating period has elapsed; however, the CPU 61 may executes the process directed to S10 only when a shift is executed for the first time in the printing cycle T, and in a shift thereafter, no process has to be executed, and the CPU 61 returns the process to S9.

At S11, the CPU 61 determines whether printing based on the printing data 50 has been complete or not. That is, the CPU 62 determines the printing processes with respect to all the printing line data arrays 55 making up the printing data 50 has finished or not. If the printing based on the printing data 50 has been complete (YES at S11), the CPU 61 finishes the energization control process program. If there exists a printing line data array 55 (NO at S11), the CPU 61 shifts the process to S12.

At S12, the CPU 61 executes other processes. Here, the CPU 61 stops the energization to the heater elements 41A and starts the non-heating period C (see FIGS. 7A, 7B and 8A through 8C). The CPU 61 then returns the process to S2.

Figure 9:
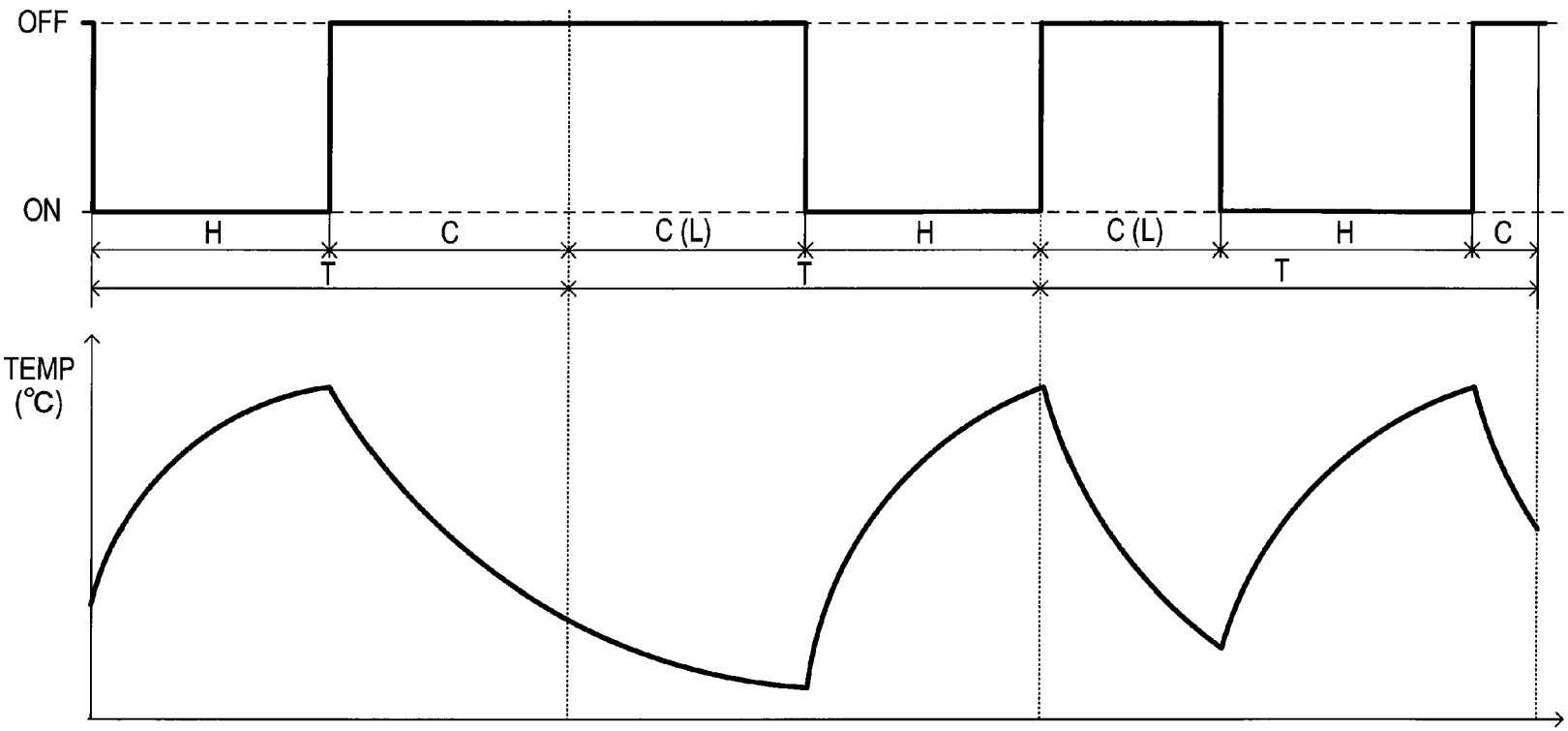
FIG. 9 is a diagram illustrating a relation between the printing cycle and the temperature of the thermal head in the first embodiment.

Next, there will be discussed the relation between the printing cycle T based on the above-described energization control process program and the temperature at the thermal head 41, referring to FIG. 9. FIG. 9 is a graph indicating, in the upper portion thereof, the voltage level of STB signal on the vertical axis and the time scale on the horizontal axis, and in the lower portion thereof, indicating the temperature of a heater element 41A on the vertical axis and the same time scale as in the upper portion on the horizontal axis. First, in the printing cycle T on the left portion of FIG. 9 there is performed printing based on the printing line data array 55 in which the number of dots conforming to the heating condition is equal to or more than a predetermined number. Here, the configuration of the printing cycle T is similar to that of FIG. 7A, and the heating period H is started concurrently with the start of the printing cycle T, and after the heating period H elapses, the non-heating period C starts. Accordingly, in the heating period H, the temperature of the thermal head 41 increases by energization to the heater element 41A. In the non-heating period C, the energization to the heater element 41A has stopped, so that the temperature of the thermal head 41 gradually decreases.

In the next printing cycle T (the center portion of FIG. 9), there is performed printing based on the printing line data array 55 in which the number of dots conforming to the heating condition is equal to or more than a predetermined number, and in a printing line data array 55 of the next printing target, the number of dots conforming to the heating condition is less than the predetermined number. Here, the above-described delay condition is satisfied (YES at S3), in the printing cycle T on the center portion of the FIG. 9, a heating delay period L made up of the first divided delay period La through the fourth divided delay period Ld starts concurrently with the start of the printing cycle T, and a heating period H starts after the elapse of the heating delay period L, in a similar manner with the printing cycle T illustrated in FIG. 7B. Here, in the heating delay period L, the energization to the heater element 41 is not executed, and the heating delay period L functions as a non-heating period C. Accordingly, after the heat is dissipated during the non-heating period C in the previous printing cycle T (on the left portion of FIG. 9), the temperature of the thermal head 41 is further decreased by the heat dissipation in the heating delay period L. That is, the tape printing apparatus 1 can secure a longer non-heating period C, so that the temperature of the thermal head 41 can be sufficiently reduced, and thus preventing the printing quality from deteriorating by the heat stored in the thermal head 41.

In the printing cycle T (on the right portion of FIG. 9) which follows the above printing cycle T, the delay condition is not satisfied because the number of dots conforming to the heating condition in the printing line data array 55 directed to the printing cycle T is less than a predetermined number, as mentioned above. Further, in this last printing cycle T, the delay restoration condition is not satisfied either. Here, as the printing cycle T (on the center portion of FIG. 9) immediately before the last printing cycle T is in the delayed state and the delay restoration condition is not satisfied in this printing cycle T (on the right portion of FIG. 9), a heating delay period L is made up of the first divided delay period La through the third divided period Lc, and is set in the similar configuration as in FIG. 8A. Accordingly, when shifting to this last printing period T (on the right portion of FIG. 9) after the elapse of the heating period H of the printing cycle T (on the center portion of FIG. 9) immediately before the last printing cycle T, the heating delay period L (non-heating period C) starts concurrently with the start of this printing cycle T. Accordingly, the temperature of the thermal head 41 heated at the heating period H in the printing cycle T (on the center portion of FIG. 9) immediately before the last printing cycle T decreases by the heat dissipation at the heating delay period L (non-heating period C). After the heating delay period L elapsed, the temperature of the thermal head 41 increases by energizing the heater element 41 at the heating period H. After the heating period H elapsed, the non-heating period C starts again, and the temperature of the thermal head 41 that has increased at the heating period H in this printing cycle T goes down at the non-heating period C. In this manner, the start of the heating period H once delayed is gradually returned according to the progress on the printing process (energizing process) in a unit of line, thereby, the tape printing apparatus can prevent the printing quality from lowering based on the differences in heating period H in the printing cycle T. The tape printing apparatus 1 directed to the first embodiment has a configuration in which a tape is conveyed toward the thermal head 41 provided in a predetermined position; therefore by gradually putting back the timing of the heating period H, satisfactory printing quality can be secured.

As discussed above, the tape printing apparatus 1 directed to the first embodiment executes printing based on the printing data 50, by controlling energization to the heater elements 41A arranged in lines on the thermal head 41, by a unit of a printing line data array 55 making up the printing data 50 per printing cycle T. The printing cycle T is made up of the heating period H and of the non-heating period C. The tape printing apparatus 1 is configured to start a heating period H concurrently with the start of the printing cycle T and to provide a non-heating period H after the heating period H elapses, in the printing cycle T.

The tape printing apparatus 1 prefetches print data when starting printing of the printing data. In at least two consecutive printing line data arrays 55 including a printing line data array 55 of the current printing target, if the number of heater elements 41A to be heated is equal to or more than a predetermined number, and at the same time the number of heater elements 41A to be heated at a printing line data array 55 of the next printing target is less than a predetermined number (YES at S3), the tape printing apparatus 1 sets a heating delay period L in the printing cycle T directed to the current printing line data array 55, and sets a heating period H after the end of the heating delay period L. Accordingly, the tape printing apparatus 1 can provide a heat delay period L (non-heating period C) of the current printing cycle T following the non-heating period C in the printing cycle T immediately before the current printing cycle T (see FIG. 9). Accordingly, the tape printing apparatus 1 can secure a non-heating period C for a long period of time, and the heat in the thermal head 41 can be dissipated sufficiently. Thereby, the tape printing apparatus 1 can prevent trailing etc. from occurring in the printed result. Further, the configuration does not change even in high-speed printing, therefore the tape printing apparatus 1 can cope with the high-speed printing without using a special component (such as a component with high withstand voltage).

The tape printing apparatus 1 sets the start of the heating period H earlier (see FIGS. 7A, 7B and 8A through 8C) by a unit of divided period obtained by dividing the heating delay period L into predetermined stages (the first divided delay period La through the fourth divided delay period Ld) in the printing cycle T directed to the current printing line data array 55 if the start of the heating period H is delayed by the start of the printing cycle (YES at S2) in the printing cycle T immediately before the current printing cycle T. That is, the tape printing apparatus 1 gradually returns to the normal state (see FIG. 7A) according to progress of printing of the printing line data arrays 55 if the start of the heating period H in the printing cycle T is delayed compared to a normal state (see FIG. 7A) as illustrated in FIG. 7B and FIG. 8A through FIG. 8C. Thereby, the thermal printer 1 can reduce the troubles in the printed result based on the difference of the start of the heating period and can provide a high quality printing in the printed result.

In the tape printing apparatus 1, when the start of the heating period H is delayed from the start of the printing cycle T (YES at S2) in a printing cycle T immediately before the current printing cycle T, if "0" is counted as the number of the heater elements 41A to be heated based on the printing line data array 55 of the current printing target (YES at S6), the heating period H starts concurrently with the start of the printing cycle T, and the non-heating period C is provided after the elapse of the heating period H. As the number of the heater elements 41A to be heated is "0, there is no trouble in the printed result if the start of the heating period H is synchronized with the start of the current printing cycle T. Accordingly, the tape printing apparatus 1 can set the start of the heating period H in a normal state without causing any trouble in the printed result; thereby can provide a high quality printed result.

In the printing cycle T immediately before the current printing cycle T, even when the start of the heating period H is delayed in a unit of divided delay period (i.e., in the middle of gradually restoring the heating delay period L) as illustrated in FIGS. 8A through 8C, if the delay restoration condition is satisfied (YES at S6), the tape printing apparatus 1 starts the heating period H concurrently with the start of the current printing cycle T and provides the non-heating period C after the elapse the heating period H. As the number of the heater elements 41A to be heated is "0", there is no trouble in the printed result if the start of the heating period H is synchronized with the start of the current printing cycle T. Accordingly, the tape printing apparatus 1 can set the start of the heating period H in a normal state without causing any trouble in the printed result, thereby can provide a high quality printed result.

Although an embodiment of the present disclosure have been described in detail, it should be understood that it is not limited to the above embodiment, and that the various changes, substitutions, and alterations could be made hereto without departing from the spirit and scope of the invention. For example, in the first embodiment, the thermal printer directed to the present disclosure is discussed referring to an example where the thermal printer is applied to the tape printing apparatus 1. However, the present disclosure is not limited to a tape printing apparatus. The present disclosure can be applied to various apparatuses if there is used a thermal head 41 in which a plurality of heater elements 41A are arranged in lines, and printing is performed by selectively energizing each of the plurality of heater elements 41A.

Further, in the first embodiment, the heating delay period L is divided into four periods and the heating delay period L is gradually restored in a unit of divided period (i.e., the first divided delay period La through the fourth divided delay period Ld), however, the disclosure is not limited to this configuration. For example, the number of the divided periods obtained by dividing the heating delay period L and stages (steps) needed to restore the heating delay period L are not limited to those discussed in the above embodiment.

Next, another embodiment (a second embodiment), which is different from the above first embodiment, will be discussed referring to the drawings. The tape printing apparatus 1 directed to the second embodiment has the same basic configuration as the tape printing apparatus 1 directed to the first embodiment, and only the control operation by the energization control program is different. Accordingly, the detailed description with respect to the basic configuration of the tape printing apparatus 1 directed to the second embodiment is omitted, and the control operation by the energization control program will be discussed in detail referring to the drawings.

Here, in the second embodiment, a printing line data array 55 which comes odd-number-th in the printing order in the printing data 50 is referred to as an odd line data array, and a printing line data piece 55 which comes even-number-th is referred to as an even line data array.

Figure 10:
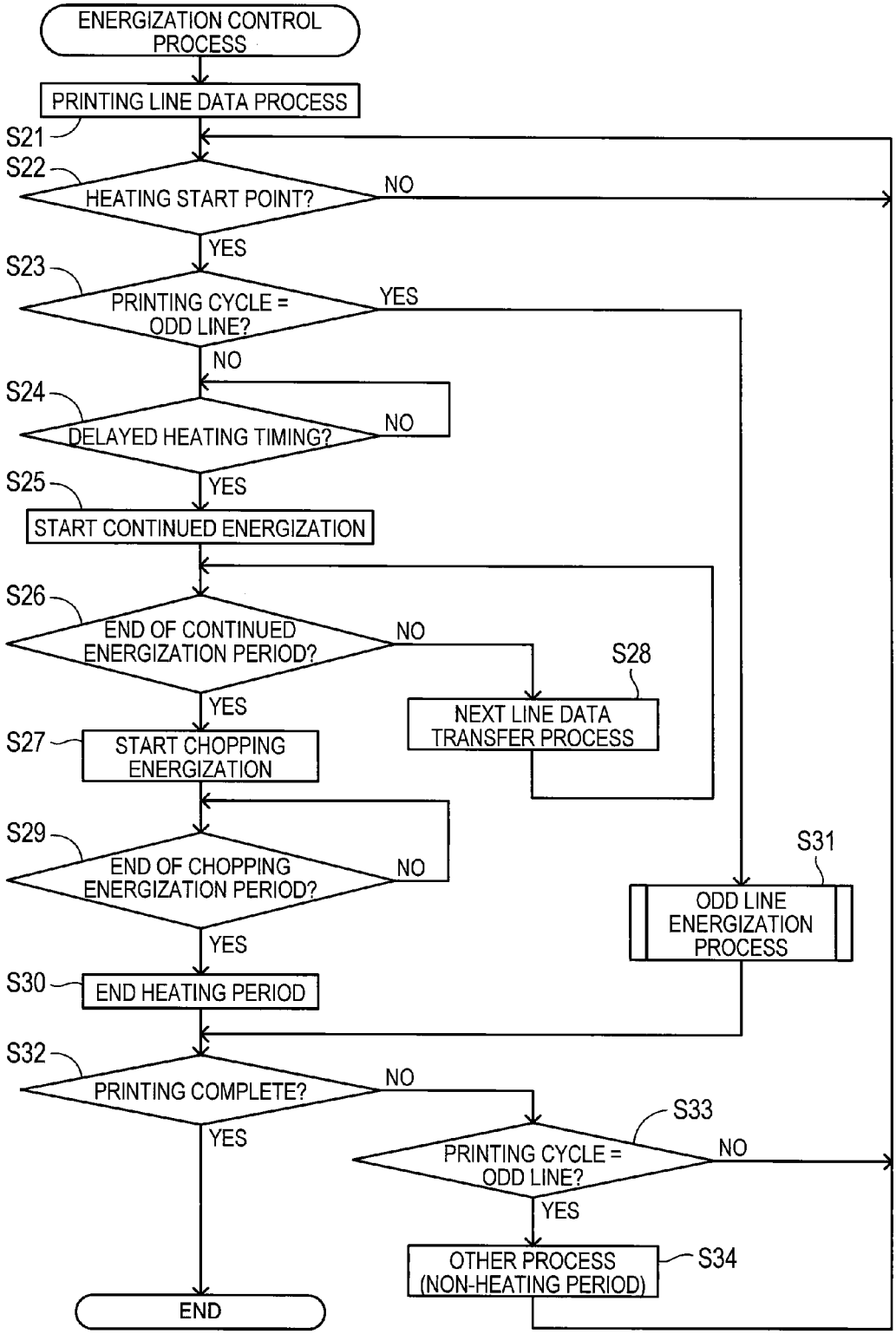
FIG. 10 is a flowchart of an energization control process program directed to a second embodiment.

Then, an energization control process program directed to the second embodiment will be discussed referring to FIG. 10, etc. The energization control process program is a program executed by the CPU 61 when printing the printing data 50 for carrying out an energization control.

First, at S21, the CPU 61 executes a printing line data process. In the printing line data process (S21), the CPU 61 prefetches the printing data 50 (see FIG. 4), identifies dots conforming to the heating condition and creates each printing line data array 55. Then, the CPU 61 transfers the first printing line data array 55 to the thermal head 41. Following this, the CPU 61 shifts the process to S22.

At S22, the CPU 61 determines whether or not a heating start point in the current printing cycle T has come. If it is determined that a heating start point has come (YES at S22), the CPU 61 shifts the process to S23. If it is determined that a heating start point has not yet come (NO at S22), the CPU 61 stands by until the heating start point comes.

At S23, the CPU 61 determines whether or not the current printing target is an odd line data array. If it is determined the current printing target is an odd line data array (YES at S23), the CPU 61 shifts the process to S31. If the current printing target is an even line data array (NO at S23), the CPU 61 shifts the process to S24.

Figure 12A:
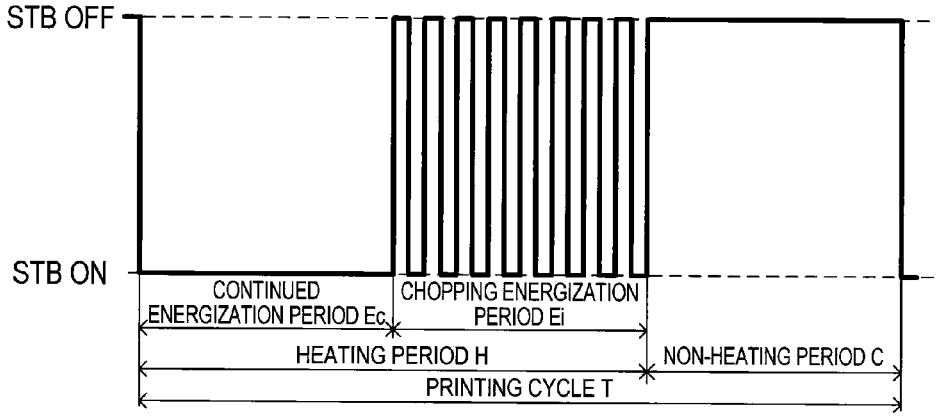
FIGS. 12A through 12C are diagrams illustrating configurations of a heating period and a non-heating period in a printing cycle directed to the second embodiment.
Figure 12B:
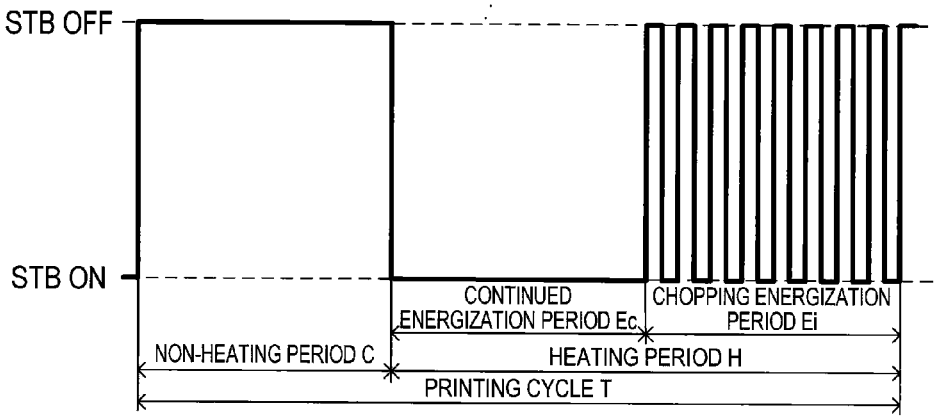
Figure 12C:
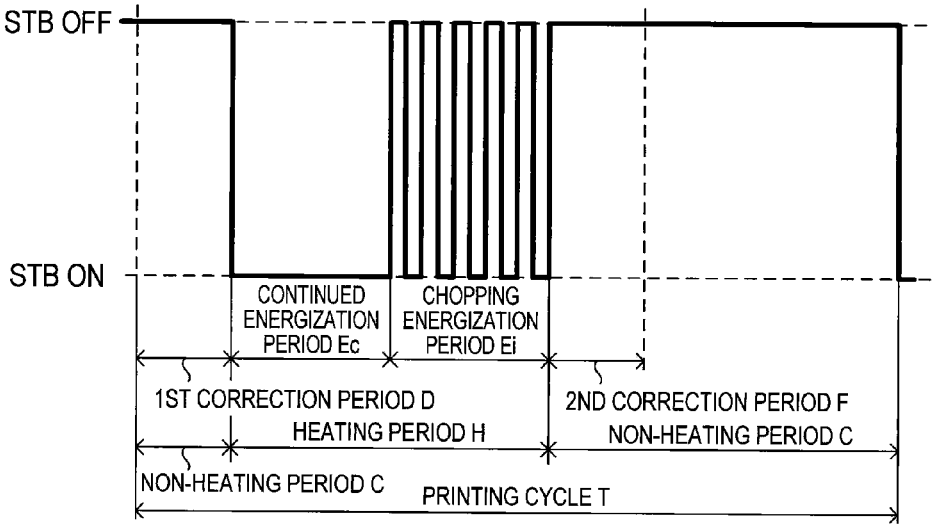

Here, the tape printing apparatus 1 directed to the second embodiment changes the configuration of a printing cycle T depending on whether the current printing target is an odd line data array or an even line data array. From now on, the above feature will be discussed referring to FIGS. 12A and 12C. FIGS. 12A and 12C are graphs each with a voltage level of the STB signal on the vertical axis, and a time scale on the horizontal axis. As illustrated in FIGS. 12A and 12C, the printing cycle T is at least made up of a heating period H and a non-heating period C. The heating period H is a time period in which heater elements 41A are heated up by energization to the heater elements 41A. The non-heating period C is a time period in which heater elements 41A dissipate heat by putting the heater elements 41A in a non-energization state.

Further, the heating period H is made up of a continued energization period Ec and a chopping energization period Ei. The continued energization period Ec is a time period in which energization to heater elements 41A is continuously performed to heat up the heater elements 41A. The chopping energization period Ei is a time period in which energization and non-energization to heater elements 41A are switched at predetermined time intervals so that the energization to the heater elements 41A is intermittently performed to heat up the heater elements 41A. A heating period H directed to the second embodiment is configured to have the chopping energization period Ei after the continued energization period Ec.

If the current printing target is an odd line data array, the printing cycle T is set to have a heating period H closer to the start of the printing cycle T, and have a non-heating period C after the elapse of the heating period H (see FIGS. 12A and 12C). Whereas if the current printing target is an even line data array, the printing cycle T is set to have a non-heating period C closer to the start of the printing cycle T, and have a heating period H after the elapse of the non-heating period C (see FIG. 12B).

The energization control process program will be discussed again, referring back to FIG. 10. After shifting to S24, the CPU 61 determines whether a delayed heating timing has come or not. If it is determined that the delayed heating timing has come (YES at S24), the CPU 61 shifts the process to S25. If it is determined that the delayed heating timing has not yet come (NO at S24), the CPU 61 stands by until it becomes the delayed heating timing. Here, if the current printing target is an even line data array, the process shifts to S24. Accordingly, the delayed heating timing indicates an end point of a non-heating period C and a start point of a heating period H. That is, if the printing target is an even line data array, the CPU 61 waits the elapse of the non-heating period C by putting the process in a standby state until it becomes the delayed heating timing.

When shifting to S25, based on the arrangement of dots conforming to the heating condition at the even line data array which is a printing target, the CPU 61 starts continued energization (i.e., continued energization period Ec) to the corresponding heater elements 41A. Then, the CPU 61 shifts the process to S26.

At S26, the CPU 61 determines whether the continued energization period Ec has ended or not. Specifically, the CPU 61 determines whether a predetermined time period has elapsed since the start of the continued energization period Ec. If it is determined that the continued energization period Ec has ended (YES at S26), the CPU 61 shifts the process to S27. If it is determined that the continued energization period Ec has not yet ended (NO at S26), the CPU 61 shifts the process to S28.

At S27, with the elapse of the continued energization period Ec, the CPU 61 starts chopping energization (i.e., a chopping energization period). Specifically, based on the arrangement of the dots conforming to the heating condition in an even line data array which is a printing target, the CPU 61 switches energization or non-energization to the corresponding heater elements 41A at predetermined intervals, for performing intermittent energization to the heater elements 41A. Then, the CPU 61 shifts the process to S29.

At S28, the CPU 61 executes a next line data transfer process. In the next line data transfer process (S28), the CPU 61 transfers a printing line data array 55 of the next printing target to the thermal head 41. Specifically, the CPU 61 transfers to the thermal head 41A pulse data based on odd line data of the next printing target. Then, the CPU 61 returns the process to S26. In FIG. 10, the CPU 61 shifts the process to S28 until the continued energization period Ec elapses, but the CPU 61 may be configured to execute the process at S28 only at the first shift to S28 in the continued energization period Ec. At a shift thereafter, the CPU 61 may be configured to return the process to S26 without performing any process (i.e., the process at S28).

At S29, the CPU 61 determines whether the chopping energization period Ei has ended or not. Specifically, the CPU 61 determines whether a predetermined period has elapsed since the start of the chopping energization period Ei. If it is determined that the chopping energization period Ei has ended (YES at S29), the CPU 61 shifts the process to S30. If it is determined that the chopping energization period Ei has not yet ended (NO at S29), the CPU 61 puts the process in a standby state until the chopping energization period Ei ends.

At S30, the CPU 61 ends the heating period H along with the end of the chopping energization period Ei. Then, the CPU 61 shifts the process to S32. With the end of the heating period H, the printing cycle T directed to the even line data array ends. That is, as illustrated in FIG. 12B, the printing cycle T directed to the even line data array is configured with a non-heating period C, a continued energization period Ec and a chopping energization period Ei, in this order.

As discussed above, if the printing target is an odd line data array (YES at S23), the CPU 61 shifts the process to an odd line energization process (S31). In the odd line energization process (S31), the CPU 61 sets a printing cycle T and performs an energization control (energization to the heater elements 41A with respect to the heating period H) targeting the odd line data array. Details of the odd line energization process (S31) will be discussed later. When the odd line energization process (S31) ends, the CPU 61 shifts the process to S32.

After shifting to S32, the CPU 61 determines the printing based on the printing data 50 has ended or not. If it is determined that the printing based on the printing data 50 has ended (YES at S32), the CPU 61 ends the energization control process program. If there exists a printing line data array 55 which has not yet become a printing target (NO at S32), the CPU 61 shifts the process to S33.

At S33, the CPU 61 determines that the printing target is an odd line data array. If the printing target is an odd line data array (YES at S33), the CPU 61 shifts the process to S34. If the printing target is an even line data array (NO at S33), the CPU 61 returns the process to S22 and performs a printing process of the next printing line data array 55 (which is an odd line data array).

At S34, the CPU 61 executes other processes. Here, the CPU 61 provides a non-heating period C in a printing cycle T directed to an odd line data array which is a printing target. Then, the CPU 61 returns the process to S22. Accordingly, in the printing cycle directed to an odd line data array, the heating period C is arranged closer to the end of the printing cycle T (see FIGS. 12A and 12C).

Figure 11:
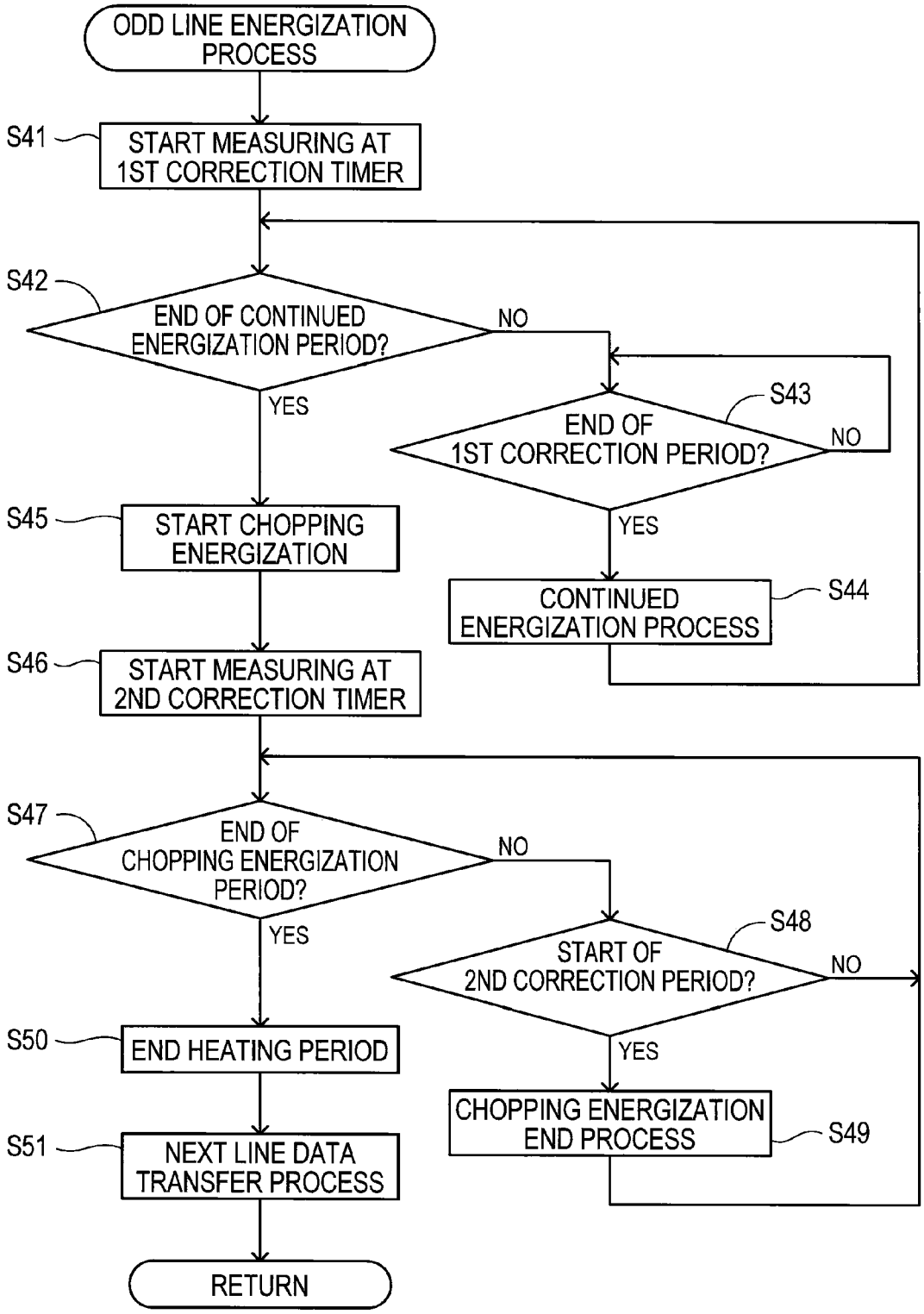
FIG. 11 is a flowchart of an odd line energization process program directed to the second embodiment.

Next, an odd line energization process program according to the second embodiment will be discussed in detail referring to FIG. 11, etc. As described above, the odd line energization process program is executed by the CPU 61 at the odd line energization process (S31), and used for setting a printing cycle T and controlling energization (energization to the heater elements 41A with respect to the heating period H) targeting the odd line data array.

At S41, the CPU 61 starts measuring at a first correction timer. As illustrated in FIG. 12C, a first correction period D is a time period to be set before a continued energization period Ec in a printing cycle T directed to a odd line data array, and energization to the heater elements 41A is not performed in the first correction period D. Accordingly, the first correction period D operates as a non-heating period C. After starting the measurement at the first correction timer, the CPU 61 shifts the process to S42.

At S42, the CPU 61 determines whether the continued energization period Ec in the printing cycle T directed to the odd line data array which is a printing target has ended or not. If it is determined that the continued energization period Ec has ended (YES at S42), the CPU 61 shifts the process to S45. If it is determined that the continued energization period Ec has not yet ended (NO at S42), the CPU 61 shifts the process to S43.

Shifting to S43, the CPU 61 determines whether or not the first correction period D has ended, based on the value of the first correction timer. If it is determined that the first correction period D has ended (YES at S43), the CPU 61 shifts the process to S44. If it is determined that the first correction period D has not yet ended (NO at S43), the CPU 61 stands by until the first correction period D ends.

At S44, the CPU 61 executes a continued energization process program. In the continued energization process program (S44), the CPU 61 starts continued energization to the corresponding heater elements 41A (that is, continued energization period Ec), based on the arrangement of dots which conform to the heating condition in the odd line data array which is a printing target. Then the CPU 61 returns the process to S42.

Upon printing the printing data 50, with respect to the first printing line data array 55 (that is, the odd line data array which comes first in the order), the CPU 61 performs the determination of S43, while setting a standard time for the determination with respect to the first correction period D to be "0". Thereby, in the printing cycle T directed to the odd line data array, the continued energization period Ec can be started concurrently with the start of the printing cycle T, and it can be made to have a configuration similar to that of FIG. 12A.

At S45, the CPU 61 starts a chopping energization (that is, the chopping energization period Ei) with the end of the continued energization period Ec. Specifically, based on the arrangement of the dots which conform to the heating condition in an even line data array which is a printing target, the CPU 61 switches energization or non-energization to the corresponding heater elements 41A in predetermined intervals for performing intermittent energization to the heater elements 41A. Then, the CPU 61 shifts the process to S46.

At S46, the CPU 61 starts measuring at a second correction timer. As illustrated in FIG. 12C, a second correction period F is a time period to be set after the chopping energization period Ei in the printing cycle T directed to an odd line data array, and energization to the heater elements 41A is not performed in the second correction period F. Accordingly, the second correction period F operates as a non-heating period C. After starting the measurement at the second correction timer, the CPU 61 shifts the process to S47.

At S47, the CPU 61 determines whether the chopping energization period Ei in the printing cycle T directed to the odd line data array which is a printing target has ended or not. Specifically, the CPU 61 performs the determination based on whether a process of S49 to be later described has been executed or not. If it is determined that the chopping energization period Ei has ended (YES at S47), the CPU 61 shifts the process to S50. If it is determined that the chopping energization period Ei has not yet ended (NO at S47), the CPU 61 shifts the process to S48.

Shifting to S48, the CPU 61 determines whether or not the start of the second correction period F has come, based on the value of the second correction timer. If it is determined that the start of the second correction period F has come (YES at S48), the CPU 61 shifts the process to S49. If it is determined that the second correction period F has not yet ended (NO at S48), the CPU 61 returns the process to S47, and continues the chopping energization until the start of the second correction period F comes.

Upon printing the printing data 50, with respect to the first printing line data array 55 (that is, the odd line data array which comes first in the order), the CPU 61 performs the determination of S48, while setting a standard time for the determination with respect to the second correction period F to be "a predetermined value (e.g., a value indicating the same moment as the end of the heating period H of FIG. 12A)." Thereby, the printing cycle T directed to the odd line data array can be made to have a configuration similar to that of FIG. 12A.

Shifting to S49, the CPU 61 performs a chopping energization end process. In the chopping energization end process (S49), triggered by the start of the second correction period F, the CPU 61 ends the chopping energization period Ei. Here, the CPU 61 sets a flag indicating that the chopping energization period Ei has ended. Accordingly, the CPU 61 in the above S47 determines whether or not the chopping energization period Ei has ended based on the existence or non-existence of the flag.

At S50, the CPU 61 ends the heating period H with the end of the chopping energization period Ei. Then, the CPU 61 shifts the process to S51. With the end of the heating period H, all the time periods in the printing cycle T directed to the odd line data array are terminated, except the non-heating period C. In the printing cycle T directed to the odd line data array, the non-heating period C is realized by S34 and S22 as described above. Thereby, as depicted in FIG. 12C, a printing cycle T directed to an odd line data array is made up of a non-heating period C based on a first correction period D, a heating period H made up of a continued energization period Ec and a chopping energization period Ei, and a non-heating period C including a second correction period F, in this order. Here, a printing cycle T directed to an odd line data array which comes first in the order is made up of a heating period H made up of a continued energization period Ec and a chopping energization period Ei, and a non-heating period C, in this order (see FIG. 12A).

At S51, the CPU 61 executes a next line data transfer process. In the next line data transfer process (S51), the CPU 61 transfers a printing line data array 55, which is the next printing target (that is, an even line data array), to the thermal head 41. Then, the CPU 61 ends the odd line energization process program, and shifts the process to S32, which is an energization control process program (see FIG. 10).

Figure 13:
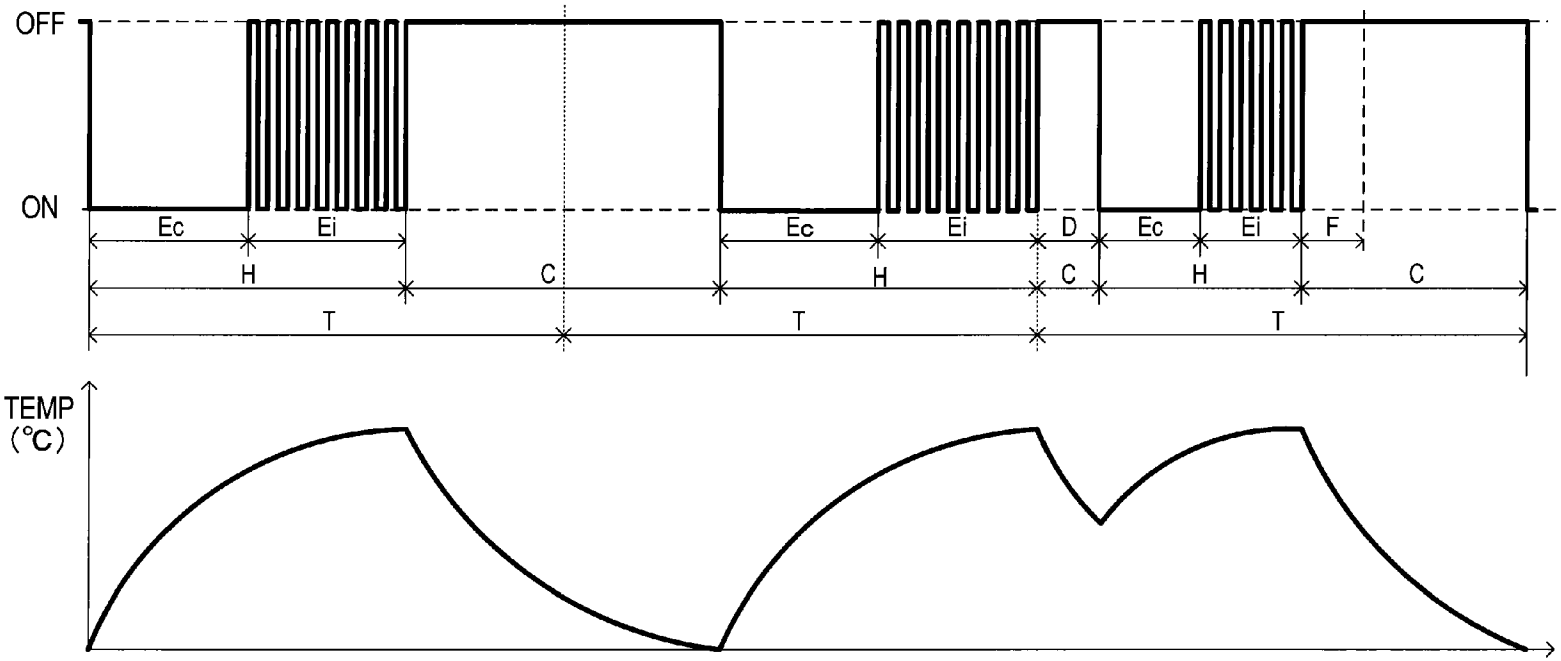
FIG. 13 is a diagram illustrating a relation between the printing cycle and the temperature of the thermal head in the second embodiment.

Next, there will be described a relation between a temperature of a thermal head 41 and a printing cycle T based on the energization control process program and on the odd line energization process program, referring to FIG. 13. The example in FIG. 13 illustrates printing cycles T directed to printing line data arrays 55 which come in first through third from the start of printing according to the printing data 50. The upper portion of FIG. 13 is a graph with the voltage level of STB signals on the vertical axis and a time scale on the horizontal axis, and the lower portion of FIG. 13 is a graph with the temperature of a heater element 41A on the vertical axis and the same time scale as in the upper portion on the horizontal axis First, in the printing cycle T directed to the odd line data array which comes first (the left portion of FIG. 13), the CPU 61 starts a continued energization period Ec concurrently with the start of the printing cycle T, and on the end of the continued energization period Ec, starts a chopping energization period Ei. Then, on the end of the chopping energization period Ei, the CPU 61 ends the heating period H, and starts a non-heating period C. Accordingly, the configuration of the printing cycle T in this case is similar to that of FIG. 12A, and made up of a continued energization period Ec, a chopping energization period Ei and a non-heating period C, in this order. In the heating period H (continued energization period Ec and chopping energization period Ei), the temperature of the thermal head 41 increases by energizing heater elements 41A. When the non-heating period C comes, the energization to the heater elements 41A is stopped and the temperature of the thermal head 41 gradually decreases.

In the printing cycle T of the even line data array which comes second (the center portion of FIG. 13), the CPU 61 stands by until it becomes a delayed heating timing, without energizing the heater elements 41A. Accordingly, in the printing cycle T of the even line data array there is provided a non-heating period C synchronized with the start of the current printing cycle T. That is, as the non-heating period C according to the first printing cycle T is followed by the non-heating period C according to the second printing cycle T without a pause, the temperature of the thermal head 41 decreased by the heat dissipation at the first non-heating period C is further decreased by the heat dissipation at the second non-heating period C. That is, the tape printing apparatus 1 can secure a longer non-heating period C so that the temperature of the thermal head 41 can be sufficiently decreased, and the tape printing apparatus 1 can prevent printing quality from being deteriorated due to the heat storage of the thermal head 41. The CPU 61 then energizes the heater elements 41A at a continued energization period Ec and a chopping energization period Ei, in this order, in the second printing period T.

In a printing cycle T of the odd line data array which comes third (the right portion of FIG. 13), the CPU 61 performs energization of a continued energization period Ec after the elapse of a first correction period D. In the first correction period D, the heater elements 41A is not energized, therefore the first correction period D operates as a non-heating period C. Accordingly, the temperature can be lowered at the thermal head 41 heated at the heating period H in the second printing cycle T. Through providing the first correction period D, the continued energization period Ec in the third printing cycle T can be made shorter than the continued energization period Ec in the first or the second printing cycle T. After the end of the continued energization period Ec, the CPU 61 performs energization of a chopping energization period Ei. In the printing cycle T in this case, the chopping energization period Ei is terminated concurrently with the start of the second correction period F. Accordingly, the chopping energization period Ei in the third printing cycle T becomes shorter than the chopping energization period Ei in the first or the second printing cycle T. After the end of the chopping energization period Ei, the CPU 61 starts dissipating the heat of the thermal head 41 heated at the heating period H in the third printing cycle T (namely, a continued energization period Ec and a chopping energization period Ei), through the second correction period F and the non-heating period C. As a result, the tape printing apparatus 1 can secure a longer non-heating period C so that the temperature of the thermal head 41 can be sufficiently decreased, and the tape printing apparatus 1 can prevent printing quality from being deteriorated due to heat storage of the thermal head 41.

Incidentally, a configuration of a printing cycle T of the even line data array which comes fourth is the same as the above-described printing period directed to the even line data array which comes second. That is, a non-heating period C in the fourth printing cycle T follows the sequence of the second correction period F and the non-heating period C in the third printing cycle T. Accordingly, a longer non-heating period C can be secured so that the tape printing apparatus 1 can sufficiently decrease the temperature of the thermal head 41, and can prevent printing quality from being deteriorated due to heat storage of the thermal head 41.

As has been described, the tape printing apparatus 1 directed to the second embodiment controls energization to heating elements 41A aligned in a thermal head 41 in a unit of a printing line data array 55 making up printing data 50, in each printing cycle T, for performing printing based on the printing data 50. The printing cycle T is made up of a heating period H and a non-heating period C.

Further, the tape printing apparatus 1 alternately changes the configuration of a printing cycle T, by distinguishing an odd line data array and an even line data array based on a printing order in printing data 50. In a printing cycle T directed to an odd line data array, a heating period H (a continued energization period Ec and a chopping energization period Ei) is set closer to the start of the printing cycle T, and following the elapse of the heating period H, a non-heating period C is provided. Meanwhile, in the printing cycle T directed to an even line data array, a non-heating period C is set closer to the start of the printing cycle T, and following the elapse of the non-heating period C, a heating period H is provided. Accordingly, in the continuation of a printing cycle T directed to an odd line data array and a printing cycle T directed to an even line data array, non-heating periods C are consecutively provided (see FIG. 13). As a result, the tape printing apparatus 1 can secure the non-heating period C for a further longer time period, and the heat stored in the thermal head 41 can be satisfactorily dissipated, making it possible to prevent occurrence of trailing etc. in a printed result. Further, even in high-speed printing, the configuration does not change, therefore the tape printing apparatus 1 can cope with the high-speed printing without using a special component (such as a component with high withstand voltage).

In addition, the tape printing apparatus 1 provides a first correction period D before a continued energization period Ec in a printing cycle T directed to an odd line data array which becomes a printing target consecutive to an even line data array, thus making it possible to shorten a continued energization period Ec in the printing cycle T, as well as to lengthen a non-heating period C in the printing cycle T. Accordingly, the tape printing apparatus 1 can dissipate the heat stored in the thermal head 41 satisfactorily and can prevent occurrence of trailing etc. in a printed result. Further, the tape printing apparatus 1 can cope with the high-speed printing without using a special component (such as a component with high withstand voltage). Moreover, the tape printing apparatus 1 can efficiently utilize heat generated during a printing cycle T directed to an even line data array, so that excellent printing can be achieved even if there is shortened a heating period H directed to an odd line data array which immediately follows the even line data array.

Further, the tape printing apparatus 1 provides a second correction period F before a chopping energization period Ei in a printing cycle T directed to an odd line data array which becomes a printing target consecutive to an even line data array, thus making it possible to shorten a chopping energization period Ei in the printing cycle T, as well as to lengthen a non-heating period C in the printing cycle T. Accordingly, the tape printing apparatus 1 can dissipate the heat stored in the thermal head 41 satisfactorily and can prevent occurrence of trailing etc. in a printed result. Further, the tape printing apparatus 1 can cope with the high-speed printing without using a special component (such as a component with high withstand voltage). Moreover, the tape printing apparatus can efficiently utilize heat generated during the printing cycle T directed to an even line data array, so that excellent printing can be achieved even if there is shortened a heating period H directed to an odd line data array which immediately follows the even line data array.

Although an embodiment of the present disclosure have been described in detail, it should be understood that it is not limited to the above embodiment, and that the various changes, substitutions, and alterations could be made hereto without departing from the spirit and scope of the invention. For example, in the second embodiment, a first correction period D and a second correction period F are provided in a printing cycle T directed to an odd line data array which becomes a printing target consecutive to an even line data array, so as to shorten both the continued energization period Ec and the chopping energization period Ei, however, this disclosure is not limited to this embodiment. That is, it may be configured to shorten only the continued energization period Ec, or may be configured to shorten only the chopping energization period Ei.

Further, the second embodiment is discussed referring to an example in which the thermal printer directed to the present disclosure is applied to the tape printing apparatus 1, however, this disclosure is not limited to a tape printing apparatus. The present disclosure can be applied to various kinds of apparatuses if printing is performed therein through using a thermal head 41 where a plurality of heater elements 41A are arranged in lines and through selectively energizing each of the plurality of heater elements 41A.

While presently exemplary embodiments have been shown and described, it is to be understood that this disclosure is for the purpose of illustration and that various changes and modifications may be made without departing from the scope of the disclosure as set forth in the appended claims.

What is claimed is:

1. A thermal printer comprising:

a thermal head including a plurality of heater elements aligned in a main scanning direction; and a control unit that:

controls energization of each of the plurality of heater elements based on printing data including a plurality of line data arrays corresponding to the plurality of heater elements respectively, for selectively heating up the plurality of heater elements, and performs printing according to an order at the printing data while taking a line data array as a basic unit, on each printing cycle including a heating period for heating up by energizing the plurality of heater elements and a non-heating period for dissipating heat by de-energizing the plurality of heater elements, wherein the control unit delays a start of a heating period in a printing cycle with respect to a start of the printing cycle for a predetermined time period when a predetermined condition with respect to the line data array is satisfied.

2. The thermal printer directed to claim 1, further comprising:

a holding unit that holds a line data array; and a heating-dot counting unit that counts number of heater elements to be heated up according to the line data array, wherein, in a printing cycle directed to the line data array, the control unit starts the heating period simultaneously with a start of the printing cycle and provides the non-heating period after elapse of the heating period, and wherein, when there continue at least two line data arrays in which number of heater elements to be heated up counted by the heating-dot counting unit is more than a predetermined number, and at same time, when, in a line data array which is a printing target following the at least two line data arrays, the number of heater elements to be heated is smaller than the predetermined number, the control unit sets, in a printing cycle directed to a line data array of a last print target in the at least two line data arrays which are continued, a heating period in a state where a start of the heating period is delayed for a predetermined delay period from a start of the printing cycle.

3. The thermal printer directed to claim 2, wherein, when the start of the heating period is delayed from the start of the printing cycle in the printing cycle of the line data array, in a printing cycle directed to the line data array which is a printing target immediately after the line data array where the start of the heating period is delayed, the control unit sets a start of a heating period earlier than the start of the heating period delayed for the predetermined delay period, for a divided period obtained by dividing the predetermined delay period into predetermined number of stages.

4. The thermal printer directed to claim 3, wherein, when the start of the heating period is delayed from the start of the printing cycle in the printing cycle of the line data array, on condition that the heating-dot counting unit counts "0" as the number of heater elements to be heated according to the line data array which is the printing target immediately after the line data array where the start of the heating period is delayed, the control unit starts the heating period simultaneously with a start of a printing cycle directed to the line data array, and provides a non-heating period after elapse of the heating period.

5. The thermal printer directed to claim 4, wherein, with respect to printing cycles of at least two consecutive line data arrays, when a start of a heating period is delayed from a start of a printing cycle, in the printing cycle of a line data array, and a start of a heating period in a printing cycle of a line data array of a last print target in the at least two consecutive line data arrays is set earlier for the divided period than the start of the heating period in the printing cycle of the line data array which is a printing target immediately before the line data array of the last print target, on condition that "0" is counted as the number of heater elements to be heated according to a line data array which is a print target following the at least two consecutive line data arrays, the control unit starts a heating period simultaneously with a start of a printing cycle directed to the line data array and provides a non-heating period after elapse of the heating period.

6. The thermal printer directed to claim 1, wherein the control unit alternately generates:

a printing cycle set as a first-period-setting wherein the heating period exists closer to a start of the printing cycle, in the printing cycle; and a printing cycle set as a second-period-setting wherein the heating period exists closer to an end of the printing cycle, in the printing cycle.

7. The thermal printer directed to claim 6, wherein the heating period comprises:

a continued energization period wherein energization to the heater elements is continued for a predetermined time period and the heater elements are continuously heated; and a chopping energization period wherein energization and de-energization to the heater elements are sequentially switched and the heater elements are intermittently heated, wherein, in the printing cycle set as the first-period-setting, which is a printing cycle following the printing cycle set as the second-period-setting, the control unit reduces the continued energization period included in the heating period in the printing cycle to a predetermined time period.

8. The thermal printer directed to claim 6, wherein the heating period comprises:

a continued energization period wherein energization to the heater elements is continued for a predetermined time period and the heater elements are continuously heated; and a chopping energization period wherein energization and de-energization to the heater elements are sequentially switched and the heater elements are intermittently heated, wherein, in the printing cycle set as the first-period-setting, which is a printing cycle following the printing cycle set as the second-period-setting, the control unit reduces the chopping energization period included in the heating period in the printing cycle to a predetermined time period.

9. The thermal printer directed to claim 7, wherein, in the printing cycle set as the first-period-setting, which is the printing cycle following the printing cycle set as the second-period-setting, the control unit reduces the chopping energization period included in the heating period in the printing cycle to a predetermined time period.

* * * * *